US008439515B1

(12) United States Patent
Maxik et al.

(10) Patent No.: US 8,439,515 B1
(45) Date of Patent: May 14, 2013

(54) REMOTE LIGHTING DEVICE AND ASSOCIATED METHODS

(75) Inventors: Fredic S. Maxik, Indialantic, FL (US); Robert R. Soler, Cocoa Beach, FL (US); David E. Barine, Cocoa, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 0 days.

(21) Appl. No.: 13/305,434

(22) Filed: Nov. 28, 2011

(51) Int. Cl.
*F21L 4/00* (2006.01)
*F21L 13/00* (2006.01)

(52) U.S. Cl.
USPC ..... 362/183; 362/276; 362/293; 362/802

(58) Field of Classification Search ..... 362/84, 362/183, 192, 276, 293, 802
See application file for complete search history.

(56) References Cited

U.S. PATENT DOCUMENTS

| | | | |
|---|---|---|---|
| 5,523,878 | A | 6/1996 | Wallace et al. |
| 5,704,701 | A | 1/1998 | Kavanagh et al. |
| 5,997,150 | A | 12/1999 | Anderson |
| 6,140,646 | A | 10/2000 | Busta et al. |
| 6,341,876 | B1 | 1/2002 | Moss et al. |
| 6,356,700 | B1 | 3/2002 | Strobl |
| 6,561,656 | B1 | 5/2003 | Kojima et al. |
| 6,594,090 | B2 | 7/2003 | Kruschwitz et al. |
| 6,733,135 | B2 | 5/2004 | Dho |
| 6,767,111 | B1 | 7/2004 | Lai |
| 6,817,735 | B2 | 11/2004 | Shimizu et al. |
| 6,870,523 | B1 | 3/2005 | Ben-David et al. |
| 6,871,982 | B2 | 3/2005 | Holman et al. |
| 6,967,761 | B2 | 11/2005 | Starkweather et al. |
| 6,974,713 | B2 | 12/2005 | Patel et al. |
| 7,042,623 | B1 | 5/2006 | Huibers et al. |
| 7,070,281 | B2 | 7/2006 | Kato |
| 7,072,096 | B2 | 7/2006 | Holman et al. |
| 7,075,707 | B1 | 7/2006 | Rapaport et al. |
| 7,083,304 | B2 | 8/2006 | Rhoads |
| 7,178,941 | B2 | 2/2007 | Roberge et al. |
| 7,184,201 | B2 | 2/2007 | Duncan |
| 7,246,923 | B2 | 7/2007 | Conner |
| 7,255,469 | B2 | 8/2007 | Wheatley et al. |
| 7,261,453 | B2 | 8/2007 | Morejon et al. |
| 7,289,090 | B2 | 10/2007 | Morgan |
| 7,300,177 | B2 | 11/2007 | Conner |
| 7,303,291 | B2 | 12/2007 | Ikeda et al. |
| 7,325,956 | B2 | 2/2008 | Morejon et al. |
| 7,342,658 | B2 | 3/2008 | Kowarz et al. |
| 7,344,279 | B2 | 3/2008 | Mueller et al. |
| 7,349,095 | B2 | 3/2008 | Kurosaki |

(Continued)

OTHER PUBLICATIONS

Tannith Cattermole, "Smart Energy Glass controls light on demand", Gizmag.com, Apr. 18, 2010, Accessed Nov. 1, 2011.

*Primary Examiner* — Jason Moon Han
(74) *Attorney, Agent, or Firm* — Mark R. Malek, Esq.; Zies Widerman & Malek

(57) ABSTRACT

A lighting device to receive solar light by a color conversion optic and convert the solar light into a powering light, increasing the efficiency of electrical power generation using a photovoltaic system. The electrical power may be stored by a battery, from which it may be drawn to drive a lighting element to emit illuminating light. The illuminating light may be received and converted by the color conversion optic into a converted light, providing illumination in a desired wavelength range. The color conversion optic may be positionable adjacent to the photovoltaic system or the lighting element to convert light. A controller may be included to control the color conversion operation. The controller may be connected to a sensor or a timer.

47 Claims, 23 Drawing Sheets

U.S. PATENT DOCUMENTS

| | | | |
|---|---|---|---|
| 7,400,439 | B2 | 7/2008 | Holman |
| 7,427,146 | B2 | 9/2008 | Conner |
| 7,429,983 | B2 | 9/2008 | Islam |
| 7,434,946 | B2 | 10/2008 | Huibers |
| 7,438,443 | B2 | 10/2008 | Tatsuno et al. |
| 7,476,016 | B2 | 1/2009 | Kurihara |
| 7,520,642 | B2 | 4/2009 | Holman et al. |
| 7,530,708 | B2 | 5/2009 | Park |
| 7,537,347 | B2 | 5/2009 | Dewald |
| 7,540,616 | B2 | 6/2009 | Conner |
| 7,598,686 | B2 | 10/2009 | Lys et al. |
| 7,605,971 | B2 | 10/2009 | Ishii et al. |
| 7,626,755 | B2 | 12/2009 | Furuya et al. |
| 7,677,736 | B2 | 3/2010 | Kasazumi et al. |
| 7,684,007 | B2 | 3/2010 | Hull et al. |
| 7,703,943 | B2 | 4/2010 | Li et al. |
| 7,705,810 | B2 | 4/2010 | Choi et al. |
| 7,709,811 | B2 | 5/2010 | Conner |
| 7,719,766 | B2 | 5/2010 | Grasser et al. |
| 7,728,846 | B2 | 6/2010 | Higgins et al. |
| 7,766,490 | B2 | 8/2010 | Harbers et al. |
| 7,819,556 | B2 | 10/2010 | Heffington et al. |
| 7,828,453 | B2 | 11/2010 | Tran et al. |
| 7,828,465 | B2 | 11/2010 | Roberge et al. |
| 7,832,878 | B2 | 11/2010 | Brukilacchio et al. |
| 7,834,867 | B2 | 11/2010 | Sprague et al. |
| 7,835,056 | B2 | 11/2010 | Doucet et al. |
| 7,841,714 | B2 | 11/2010 | Gruber |
| 7,845,823 | B2 | 12/2010 | Mueller et al. |
| 7,889,430 | B2 | 2/2011 | El-Ghoroury et al. |
| 7,972,030 | B2 | 7/2011 | Li |
| 7,976,205 | B2 | 7/2011 | Grotsch et al. |
| 8,016,443 | B2 | 9/2011 | Falicoff et al. |
| 8,047,660 | B2 | 11/2011 | Penn et al. |
| 8,049,763 | B2 | 11/2011 | Kwak et al. |
| 8,061,857 | B2 | 11/2011 | Liu et al. |
| 8,070,302 | B2 | 12/2011 | Hatanaka et al. |
| 8,083,364 | B2 | 12/2011 | Allen |
| 8,096,668 | B2 | 1/2012 | Abu-Ageel |
| 2003/0039036 | A1 | 2/2003 | Kruschwitz et al. |
| 2004/0052076 | A1 | 3/2004 | Mueller et al. |
| 2004/0218390 | A1 | 11/2004 | Holman et al. |
| 2005/0174768 | A1 | 8/2005 | Conner |
| 2005/0190430 | A1 | 9/2005 | Patel et al. |
| 2006/0002101 | A1 | 1/2006 | Wheatley et al. |
| 2006/0002108 | A1 | 1/2006 | Ouderkirk et al. |
| 2006/0002110 | A1 | 1/2006 | Dowling et al. |
| 2006/0164005 | A1 | 7/2006 | Sun |
| 2006/0164607 | A1 | 7/2006 | Morejon et al. |
| 2006/0285078 | A1 | 12/2006 | Kasazumi et al. |
| 2006/0285193 | A1 | 12/2006 | Kimura et al. |
| 2006/0291269 | A1 | 12/2006 | Doucet et al. |
| 2007/0013871 | A1 | 1/2007 | Marshall et al. |
| 2007/0146639 | A1 | 6/2007 | Conner |
| 2007/0159492 | A1 | 7/2007 | Lo et al. |
| 2007/0188847 | A1 | 8/2007 | McDonald et al. |
| 2007/0211449 | A1 | 9/2007 | Holman et al. |
| 2007/0241340 | A1 | 10/2007 | Pan |
| 2007/0263298 | A1 | 11/2007 | El-Ghoroury et al. |
| 2007/0273794 | A1 | 11/2007 | Sprague et al. |
| 2008/0143970 | A1 | 6/2008 | Harbers et al. |
| 2008/0143973 | A1 | 6/2008 | Wu |
| 2008/0198572 | A1 | 8/2008 | Medendorp |
| 2008/0218992 | A1 | 9/2008 | Li |
| 2008/0232084 | A1 | 9/2008 | Kon |
| 2008/0285271 | A1 | 11/2008 | Roberge et al. |
| 2009/0046307 | A1 | 2/2009 | Kwak et al. |
| 2009/0059099 | A1 | 3/2009 | Linkov et al. |
| 2009/0059585 | A1 | 3/2009 | Chen et al. |
| 2009/0128781 | A1 | 5/2009 | Li |
| 2009/0129079 | A1 | 5/2009 | Grotsch et al. |
| 2009/0262516 | A1 | 10/2009 | Li |
| 2009/0273918 | A1 | 11/2009 | Falicoff et al. |
| 2010/0006762 | A1 | 1/2010 | Yoshida et al. |
| 2010/0046234 | A1 | 2/2010 | Abu-Ageel |
| 2010/0061068 | A1 | 3/2010 | Geissler et al. |
| 2010/0061078 | A1 | 3/2010 | Kim |
| 2010/0103389 | A1 | 4/2010 | McVea et al. |
| 2010/0110516 | A1 | 5/2010 | Penn et al. |
| 2010/0128233 | A1 | 5/2010 | Liu et al. |
| 2010/0165599 | A1 | 7/2010 | Allen |
| 2010/0202129 | A1 | 8/2010 | Abu-Ageel |
| 2010/0231863 | A1 | 9/2010 | Hikmet et al. |
| 2010/0232134 | A1 | 9/2010 | Tran |
| 2010/0244700 | A1 | 9/2010 | Chong et al. |
| 2010/0302464 | A1 | 12/2010 | Raring et al. |
| 2010/0315320 | A1 | 12/2010 | Yoshida |
| 2010/0320928 | A1 | 12/2010 | Kaihotsu et al. |
| 2010/0321641 | A1 | 12/2010 | Van Der Lubbe |
| 2010/0321933 | A1 | 12/2010 | Hatanaka et al. |

REMOTE LIGHTING DEVICE AND ASSOCIATED METHODS

FIELD OF THE INVENTION

The present invention relates to the field of lighting devices and, more specifically, lighting devices that may utilize a color conversion optic to increase efficiency receiving, storing, and using electrical power to remotely drive a lighting element.

BACKGROUND OF THE INVENTION

Lighting devices may include light emitting diodes (LEDs) to emit a light that may illuminate a space. Blue LEDs may emit a high efficacy light. However, the light emitted from blue LEDs may be visually undesirable to consumers. Traditionally, consumers may prefer a natural white light, which that may be defined by wavelength ranges including a higher concentration of light with longer wavelengths.

The light emitted from blue LEDs may be passed through a conversion material to convert the blue light into light within a different wavelength range. Often, such conversion materials are created by using phosphors. These wavelength conversion materials may sometimes be applied to a lens or optic located in line with the light emitted from a lighting element. In some instances, the conversion coating is applied to the lighting element itself. A number of disclosed inventions exist that describe lighting devices that utilize a conversion material applied to an LED, converting light with a source wavelength range into light converted wavelength range.

Additionally, LEDs may be used in conjunction with a photovoltaic system to provide illumination at locations that may lack access to a traditional power infrastructure, which may otherwise be referred to as "the grid." To maximize profitability, a developer of such off grid lighting systems may desire to use low cost solar cells with the photovoltaic system. These low cost solar cells may include silicon based materials to convert the light from a light source, such as the sun, into electrical power. However, a majority of the light emitted from the sun may be within a wavelength range that is inefficient for conversion into electrical power, such as blue or ultraviolet light having short wavelengths.

As a result, there exists a need for a remotely located lighting device that provides an ability to convert the wavelength range of a light received from light source to maximize the efficiency of generating electrical power from the converted powering light. There exists an additional need to store the electrical power generated from the powering light so that it may be used to drive a light source. There further exists a need to provide a lighting element with electrical power so that it may emit a high efficacy light to be converted into a desirable wavelength range. Finally, there exists a need for a remote lighting device that may combine all these needs into one device to perform wavelength conversion, electrical power generation, and light emitting operations as one system.

SUMMARY OF THE INVENTION

The present invention, according to at least one embodiment, relates to a remote lighting device to convert the wavelength range of a light received from light source. The wavelength conversion may advantageously increase the efficiency of electrical power generation from the converted powering light. Additionally, the remote lighting device, according to an embodiment of the present invention, may store the electrical power generated from the powering light to drive a light source. The remote lighting device, according to an embodiment of the present invention, may also advantageously provide a lighting element that may emit a high efficacy light to be converted into a desirable wavelength range. Finally, the remote lighting device, according to an embodiment of the present invention, may advantageously combine the aforementioned operations of wavelength conversion, electrical power generation, electrical power storage, and the light emission into one device that may allow simplified operation and increased efficiency.

These and other objects, features, and advantages according to an embodiment of the presenting invention are provided by a remote lighting device comprising a photovoltaic system that may accept powering light, a lighting element in communication with a battery and that may emit illuminating light, and a controller. The controller may be in communication with the photovoltaic system, the lighting element, and the battery, and a color conversion optic.

The color conversion optic, according to an embodiment of the present invention, may include a conversion material comprised of phosphors and/or quantum dots. The color conversion optic may convert a solar light to the powering light. Similarly, the color conversion optic may convert the illuminating light to a converted light.

The remote lighting device, according to an embodiment of the present invention, may operate in a charge state and a power state. The photovoltaic system may generate electrical power to be stored by the battery when the lighting device operates in a charge state. Additionally, the lighting element may be driven by the electrical power stored by the battery when the lighting device operates in a power state. The controller may selectively enable operation between the charge state and the power state.

The color conversion optic, according to an embodiment of the present invention, may be movable between a first position and a second position. The first position may be defined as the color conversion optic being positioned adjacent to the photovoltaic system to convert the solar light to the powering light during the charge state. The second position may be defined as the color conversion optic being positioned adjacent to the lighting element to convert the illuminating light to the converted light during the power state.

The remote lighting device, according to an embodiment of the present invention, may include an electromechanical device to move the color conversion optic between the first position and the second position. Similarly, the remote lighting device of the may include a repositionable mirror to receive and reflect the solar light. The repositionable mirror may also receive and reflect the illuminating light. Additionally, the color conversion optic may be positioned adjacent to the repositionable mirror. In an embodiment of the present invention, the repositionable mirror may be included in a microelectromechanical system (MEMS).

Additionally, according to an embodiment of the present invention, the color conversion optic may be positioned adjacent to the photovoltaic system and the lighting element. This positioning may allow substantially simultaneous operation in the charge state and power state.

According to an embodiment of the present invention, the controller may include a timer. The controller may analyze data provided by the timer and control operation between the power state and the charge state based upon the data provided by the timer. The controller may additionally be communicatively connected to a sensor to receive sensory information. The controller may analyze the sensory information provided by the sensor to control operation between the power state and the charge state. The sensor may detect whether the solar light is present and generates the sensory information regarding presence of the solar light. The controller may be communicatively connected to a timer and a sensor, wherein the controller may control operation between the power state and the charge state based on the sensor and the timer.

The controller, according to an embodiment of the present invention, may additionally be communicatively connected to a radio logic board to transmit and receive communication information. The communication information may be used by the controller to control operation between the power state and the charge state.

In an embodiment of the present invention, the lighting element may be a light emitting diode. More specifically, the light emitting diode may emit the illuminating light within a wavelength range between 200 and 500 nanometers.

A method aspect, according to an embodiment of the present invention, is for using the remote lighting device, including the steps of selectively enabling operation between a charge state and a power state using the controller. Operating in the charge state may include receiving a solar light by the color conversion optic and converting the solar light into a powering light using the color conversion optic. Operating in the charge state may additionally include receiving the powering light and generating electrical power to be stored by the battery using the photovoltaic system.

According to an embodiment of the present invention, operating in the power state may include driving the lighting element using the electrical power stored by the battery to emit an illuminating light. Operating in the power state may additionally include receiving the illuminating light and converting the illuminating light into a converted light using the color conversion optic.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below;" "upper," "lower," and other like terms are used for the convenience of the reader in reference to the drawings. Also, a person skilled in the art should notice this description may contain other terminology to convey position, orientation, and direction without departing from the principles of the present invention.

Referring now to FIGS. 1-23, a remote lighting device 10 according to an embodiment of the present invention is now described in greater detail. Throughout this disclosure, the remote lighting device 10 may also be referred to as a lighting device, a device, an embodiment, or the invention. Alternate references of the lighting device 10 in this disclosure are not meant to be limiting in any way.

Figure 1:
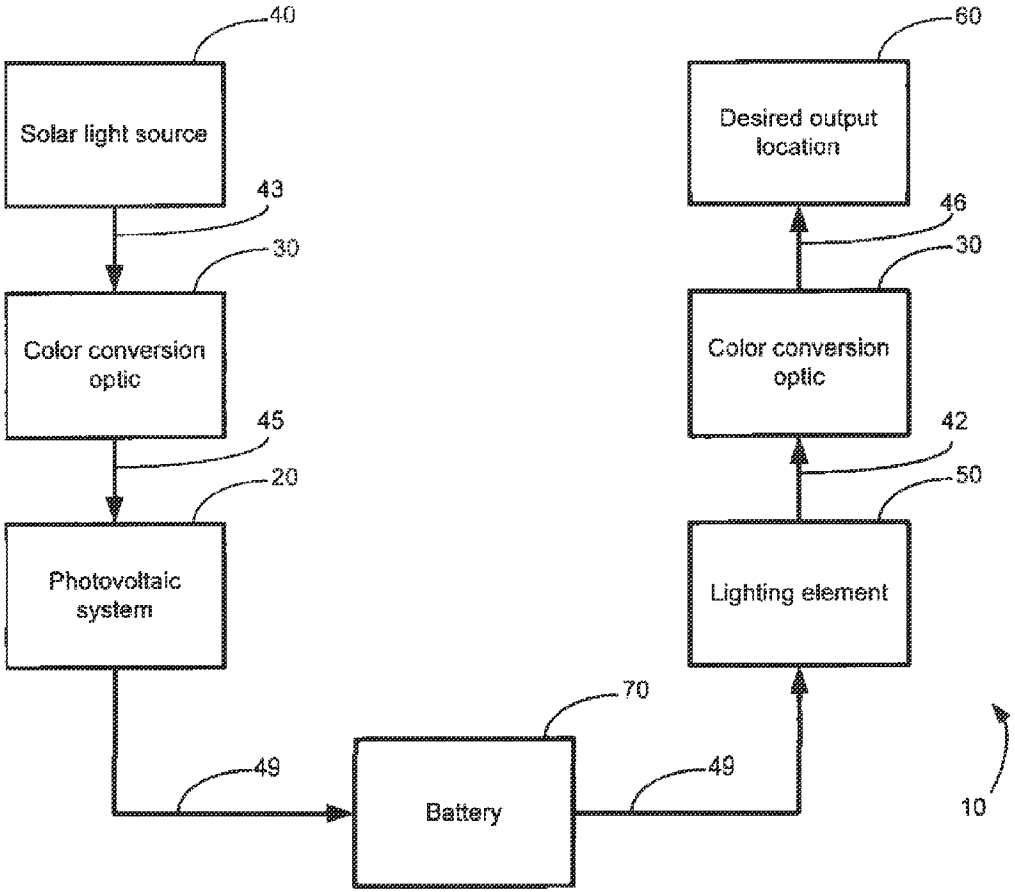
FIG. 1 is a block diagram of the remote lighting device according to an embodiment of the present invention.

As perhaps best illustrated in FIG. 1, the lighting device 10, according to an embodiment of the present invention, may include a color conversion optic 30 to convert solar light 43 received from a light source 40 into a powering light 45. The powering light 45 may be used to generate electrical power 49 using a photovoltaic system 20. The energy of the electrical power 49 may be stored in a battery 70. The electrical power 49 may also be drawn from the energy stored in the battery 70 to drive a lighting element 50. The lighting element 50 may emit an illuminating light 42, which may be converted into a converted light 46 by the color conversion optic 30. The converted light 46 may be directed in the desired output direction 60. The color conversion optic 30 may include a conversion material. The color conversion optic 30 may also be positioned adjacent to the photovoltaic system 20 and/or the lighting element 50 to convert light with one wavelength range into light with an alternate wavelength range. A controller 61 may be included to control the operation of the lighting device 10 between a charge state 84 and a power state 82, as will be described in greater detail below, and as perhaps best illustrated additionally in FIGS. 5-7 and 16.

As illustrated in FIG. 1, for example, a solar light 43 may be emitted by the light source 40. The light source 40 may include the sun, which may emit light in a solar wavelength range. A person of skill in the art will appreciate that the an embodiment of the present invention may include a solar light 43 generated by a light source 40 other than the sun, such as the moon, burning of a combustible material, or another process that produces light within a wavelength range that may be converted by a color conversion optic 30. In the interest of clarity, and without limitation, solar light 43 will be assumed to be sunlight within this disclosure, unless otherwise described.

Figure 2:
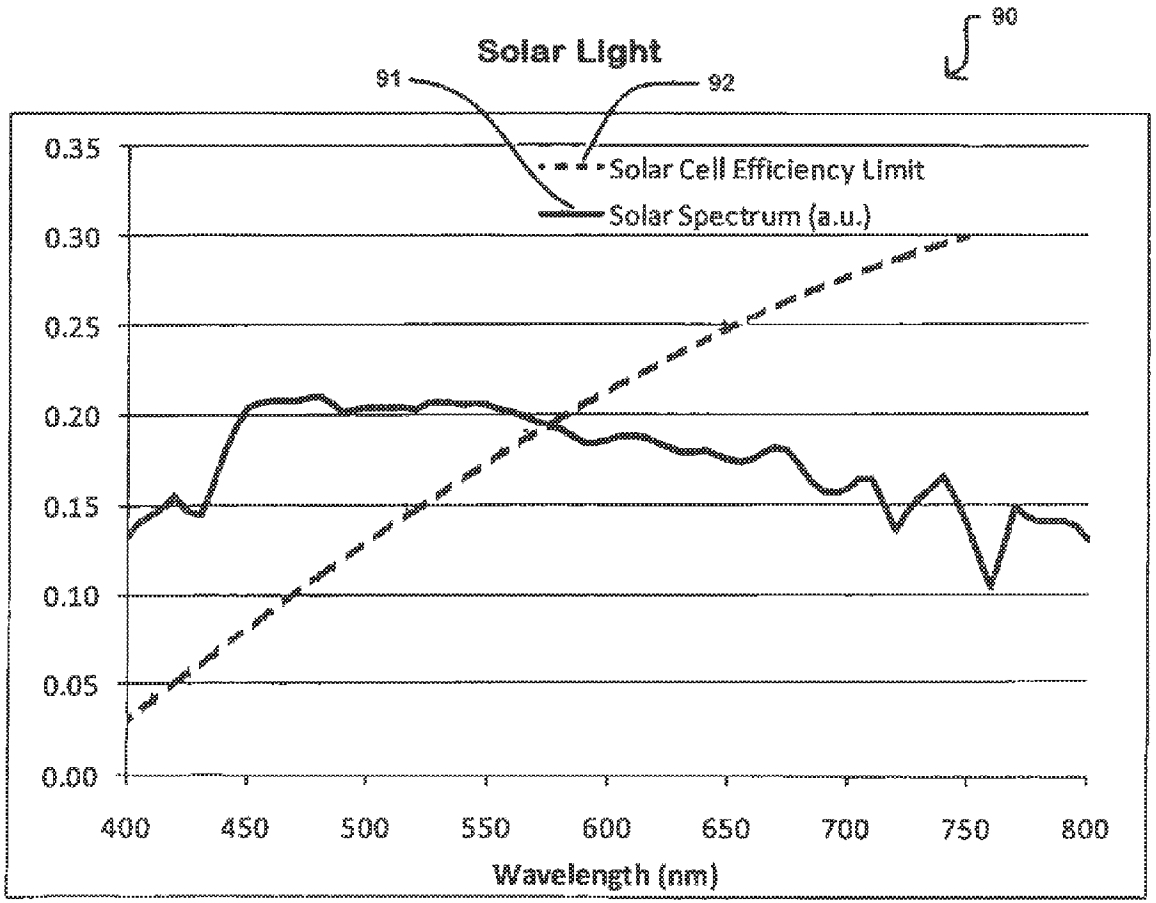
FIG. 2 is a chart illustrating the wavelength range of a solar spectrum as it relates to the efficiency of a photovoltaic system according to an embodiment of the lighting device of the present invention.

The solar wavelength range may be best illustrated by graph 90 of FIG. 2. Line 91 of graph 90 represents the relative intensity of the solar light 43 emitted by the solar light source 40 in a solar spectrum. As line 91 illustrates, the light emitted by the light source 40 may include a substantial amount of light within a range of short wavelengths. Short wavelengths may correspond with ultraviolet and blue wavelength ranges. Line 92 of graph 90 represents the efficiency of a photovoltaic system 20, such as a solar cell, when converting solar light 43 into electrical power 49. The photovoltaic system 20 and the conversion operation will be discussed below in more detail.

Referring back to FIG. 1, along with reference to FIGS. 3-5, the photovoltaic system 20, included in the lighting device 10, according to an embodiment of the present invention, will now be discussed. A photovoltaic system 20 is a system that may convert solar radiation included in the solar light 43 received from a light source 40, such as the sun, to generate electrical power 49.

A photovoltaic system 20 may include semiconductors to convert the solar light 43 into an electrical current, which may provide the electrical power 49 used to drive electrical circuits and devices. These semiconductors may be comprised of materials such as monocrystalline silicon, polycrystalline silicon, amorphous silicon, cadmium telluride, copper indium selenide, germanium, indium gallium arsenide, lead (II) sulfide, and other photovoltaic semiconductors that would be apparent to a person of skill in the art. A skilled artisan will further appreciate that the aforementioned semiconductors may be selected with respect to sensitivity within select wavelength ranges and bandgap properties for each semiconductor.

The semiconductors included within a photovoltaic system 20 may be used to create photodiodes, or electronic components may create a current or voltage when exposed to light. This conversion of light into electrical power 49 may be known as the photoelectric effect, which will be described below.

As a photon, the elementary particle of light, may engage the photodiode, an electron may be excited by the engagement. The excited electron may thus flow in the forward direction of the diode, creating a hole at its original location. A hole will be understood by a person of skill in the art to be defined as the lack of an electron at a position where the electron could exist within an atomic lattice. Correspondingly, a new electron may be accepted to replace the excited, removed electron flowing in the forward direction of the diode, filling the hole. The new electrons may be continually accepted by the atomic lattice to fill the holes left by excited electrons, resulting in a flow of electrons.

As the flow of electrons may continue, electrons may collect at the cathode of the photodiode. Correspondingly, the holes may collect at the anode of the photodiode. Due to the movement of electrons, a photocurrent may be produced flowing from the anode to the cathode. Also, as the flow of photocurrent may be restricted, a voltage may build due to the photovoltaic effect. As these processes continue, electrical power 49 may be generated as a product of the photovoltaic effect.

Solar cells may be used to convert solar light 43 into electrical power 49. Solar cells are a type of photovoltaic system 20 that may be adapted to generating electrical power 49 from the solar radiation included in solar light 43. The solar cells may further include an antireflective coating, such as silicon nitride, to increase the amount of light received by the solar cell. A person of skill in the art will appreciate that the use of solar cells within this disclosure is not intended to limit the photovoltaic system 20 in any way. Accordingly, the discussion of solar cells is provided as an illustrative embodiment of the photovoltaic system 20 included as part of the lighting device 10 of the present invention.

Figure 3:
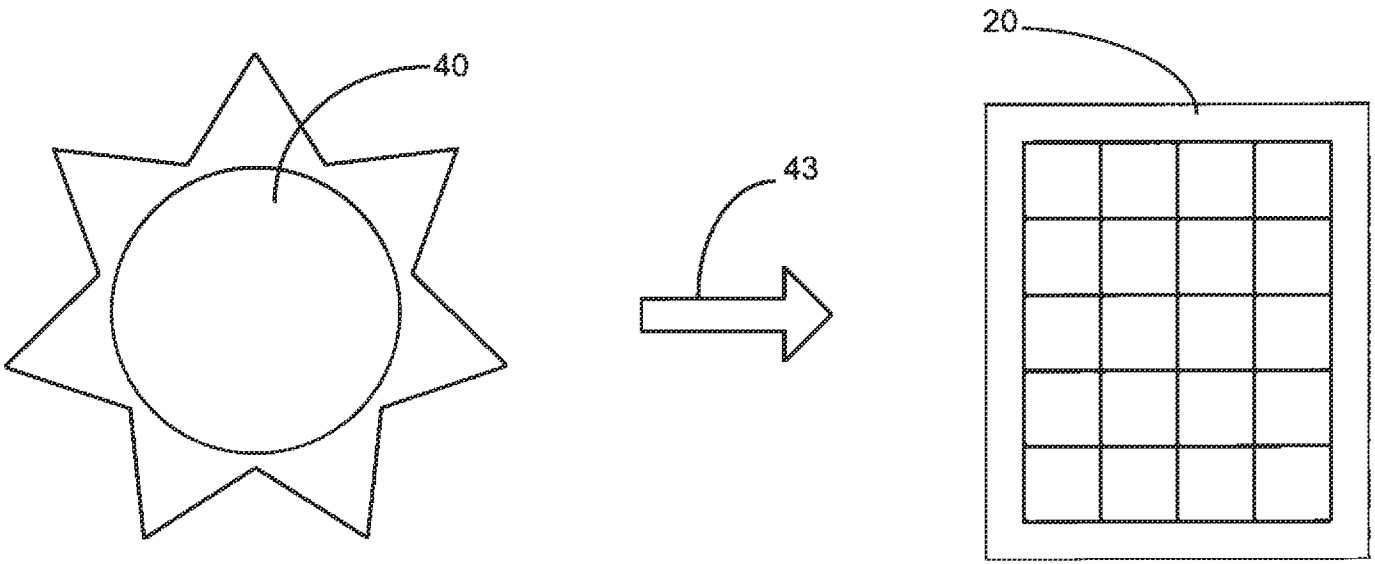
FIG. 3 is a block diagram of the photovoltaic system receiving solar light from the light source according to an embodiment of the lighting device of the present invention.
Figure 4:
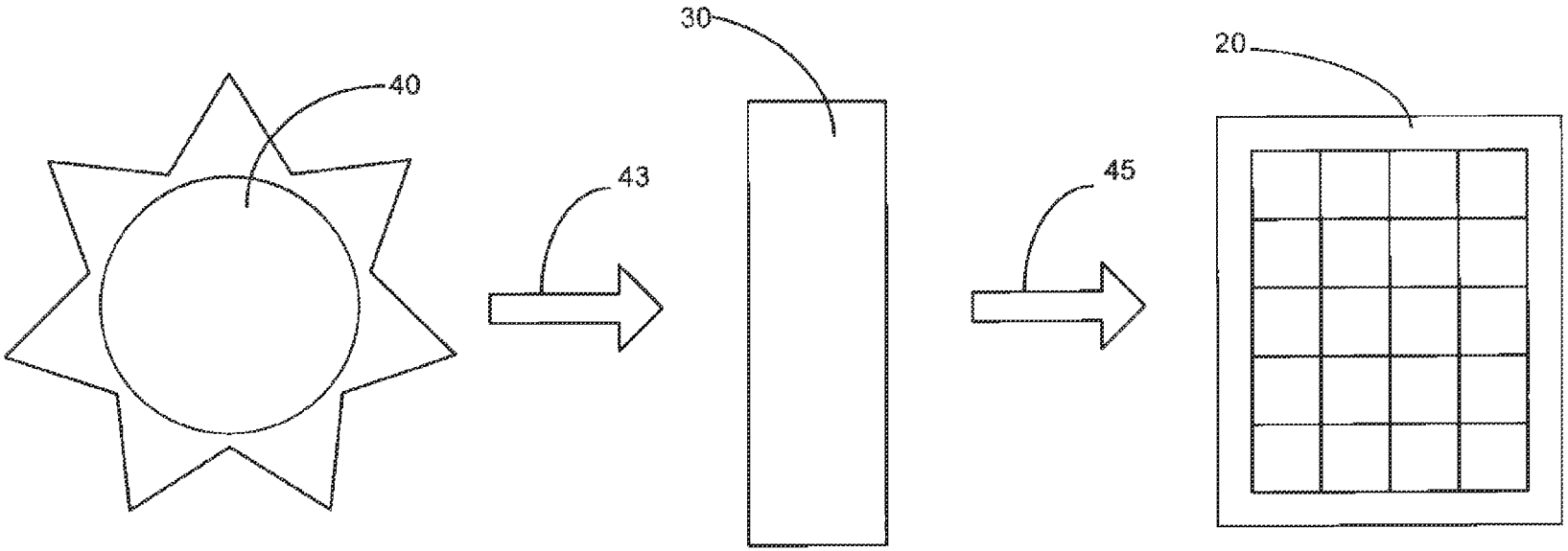
FIG. 4 is a block diagram of the photovoltaic system receiving powering light converted by a color conversion optic, according to an embodiment of the lighting device of the present invention.
Figure 5:
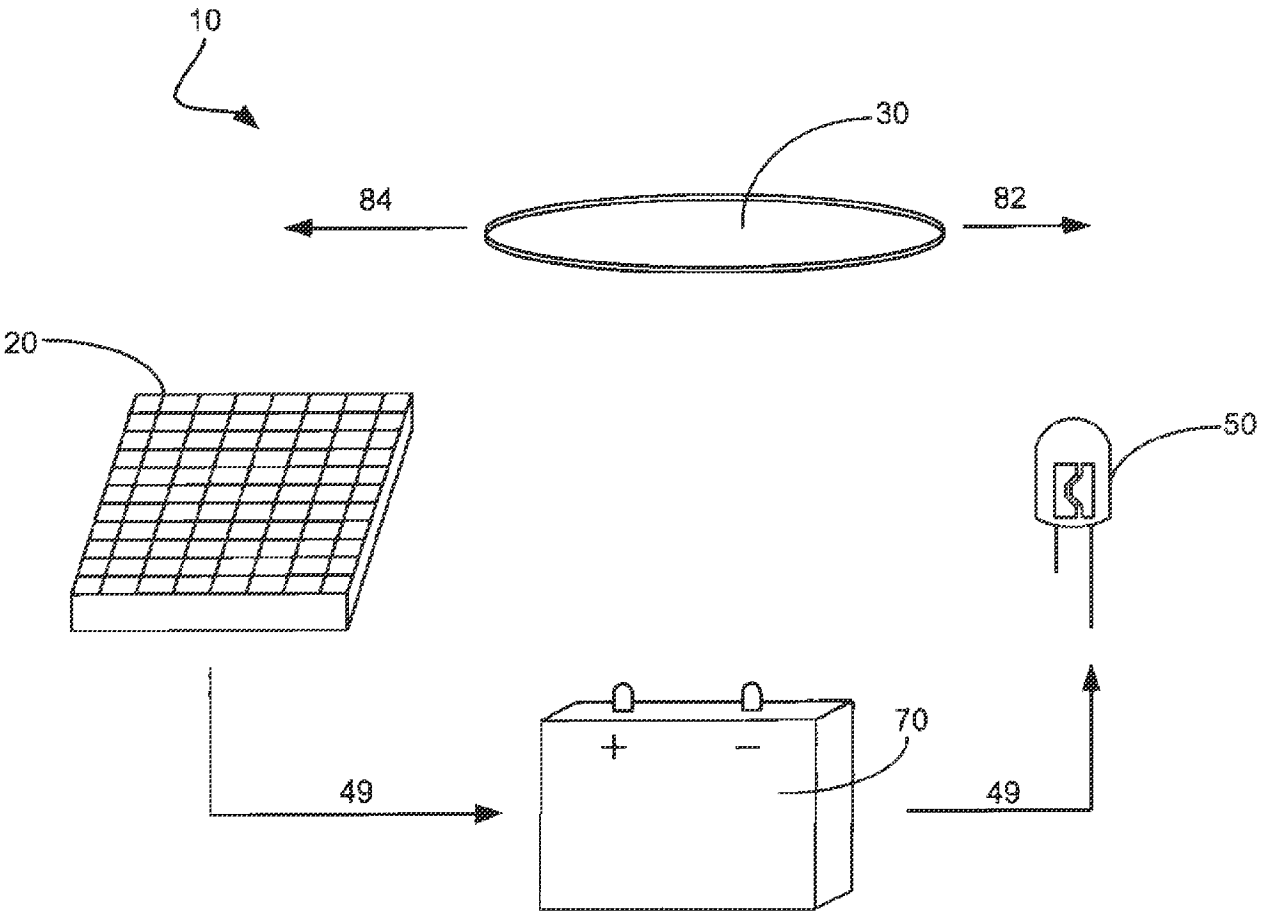
FIG. 5 is a block diagram of the lighting device according to an embodiment of the present invention including a repositionable color conversion optic.

Referring now additionally to FIGS. 3-5 the color conversion optic 30 will now be discussed in greater detail. The color conversion optic 30 may be located in a first position between the light source 40 and the photovoltaic system 20. The color conversion optic 30 may also be located in a second position between the lighting element 50 and the desired output direction 60. The photovoltaic system 20 and lighting element 50 may be operatively connected to the battery 70.

The color conversion optic 30 may be movably positioned between the two aforementioned positions. A person of skill in the art will appreciate the positioning of the color conversion optic 30 between the aforementioned positions to include the first position, the second position, or any position ranging between the first position and the second position. The color conversion optic 30 may also be located adjacent to the photovoltaic system 20 and/or the lighting element 50, which will be discussed in greater detail later along with FIGS. 12-13.

A person of skill in the art will additionally appreciate that the lighting device 10, according to an embodiment of the present invention, may include a plurality of color conversion optics 30. The plurality of color conversion optics 30 may be positioned, collective or separately, adjacent to the photovoltaic system 20, lighting element 50, or at an intermediate position between the photovoltaic system 20 and the lighting element 50. It would be understood by a skilled artisan that at least one color conversion optic 30 may be positioned adjacent to the photovoltaic system 20 and the lighting element 50 approximately simultaneously.

The color conversion optic 30 may include a conversion material, which may alter the source wavelength range of the solar light 43 received from the light source 40 into a converted wavelength range of a powering light 45. The powering light 45 may be received by the photovoltaic system 20. The color conversion optic 30 may additionally alter the source wavelength range of the illuminating light 42, emitted from the lighting element 50, into the converted wavelength range of a converted light 45, which may be directed in the desired output direction 60.

In this disclosure, the color conversion optic 30 may be described as a structural element located between the light source 40 and the photovoltaic system 20 in a first position, and between the lighting element 50 and the desired output direction 60 in a second position. The color conversion optic 30 may alternatively be located adjacent to the photovoltaic system 20 and/or the lighting element 50, as perhaps best illustrated in FIGS. 12-13. In this embodiment, an array of photovoltaic systems 20 and lighting elements 50 may be located adjacent to a substantially stationary color conversion optic 30. However, a person of skill in the art will appreciate the inclusion of additional embodiments wherein the adjacent color conversion optic 30 may be movable. With these configurations, solar light 43 may pass through the color conversion optic 30 prior to being received by the photovoltaic system 20 as powering light 45. Similarly, illuminating light 42 may pass through the color conversion optic 30 prior to being projected in the desired output direction 60 as converted light 46.

Figure 6:
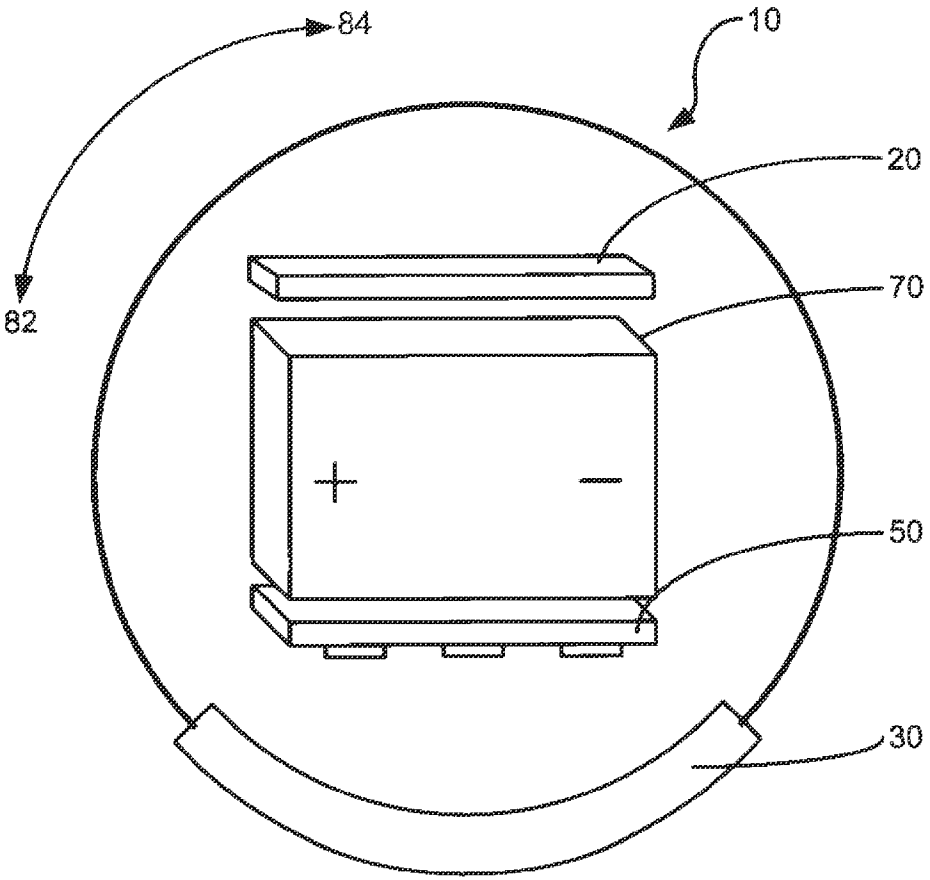
FIG. 6 is a perspective view of the lighting device according to an embodiment of the present invention including a rotatable color conversion optic in the power state.
Figure 7:
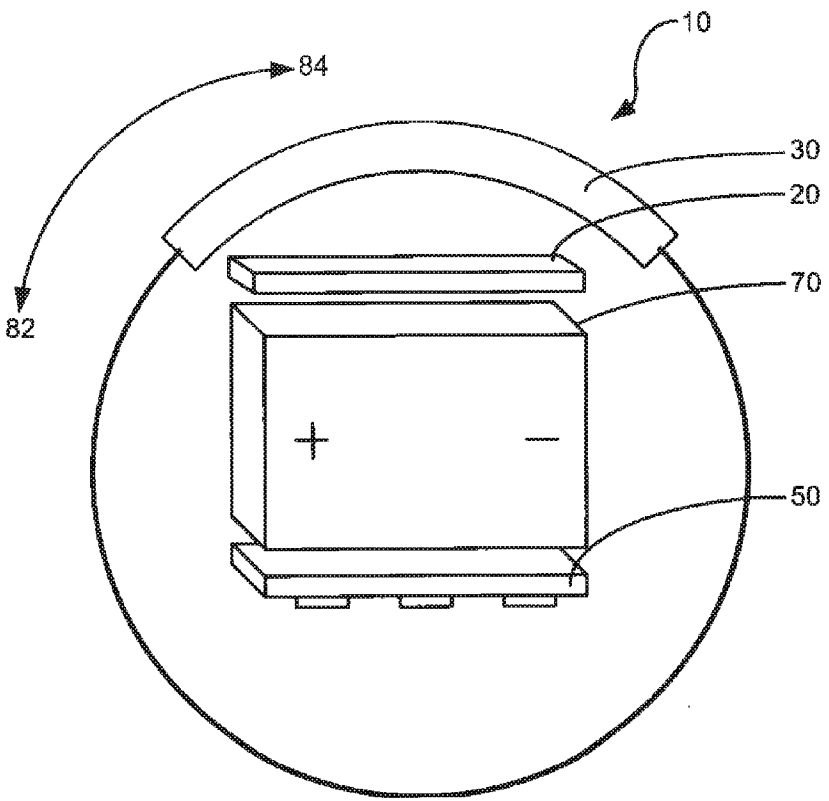
FIG. 7 is a perspective view of the lighting device according to an embodiment of the present invention including a rotatable color conversion optic in the charge state.

The color conversion optic 30 may be movably or rotatably positioned relative to the photovoltaic system 20, battery 70 and/or lighting element 50, as perhaps best illustrated in FIGS. 5-7. The color conversion optic 30 may be connected to an electromechanical device, which may orient the color conversion optic 30 between the charge state 84 and the power state 82. Electromechanical devices may include, but should not be limited to, motors, pistons, actuators, electromagnetic devices, pneumatics, hydraulics, and other devices capable of generating motion.

Additionally, a color conversion optic 30 may be rotatably positioned to allow the lighting device 10, according to an embodiment of the present invention, to operate in the power state 82 (FIG. 6) or the charge state 84 (FIG. 7). A person of skill in the art will appreciate rotatable positioning to include rotating the color conversion optic 30 in a clockwise and/or counterclockwise direction. Color conversion optics 30 that may be rotatably positioned may also include an electromechanical device to provide physical motion.

As perhaps best illustrated in FIGS. 8-11, the lighting device 10, according to an embodiment of the present invention, may include a repositionable mirror 35, which may reflect the light received from a first direction to a second direction. The repositionable mirror 35 may be operatively positioned as a part of the lighting device 10 such that the repositionable mirror 35 may receive and convert the solar light 43 and the illuminating light 42 into the powering light 45 and the converted light 46, respectively. More specifically, in the charge state 84, the repositionable mirror 35 may be positioned to receive light from a light source 40 in a first direction, reflecting the light in a second direction to the photovoltaic system 20. Similarly, in the power state 82, the repositionable mirror 35 may be positioned to receive light from a lighting element 50 in the first direction, reflecting the light in a second direction, which may be the desired output direction 60.

Figure 8:
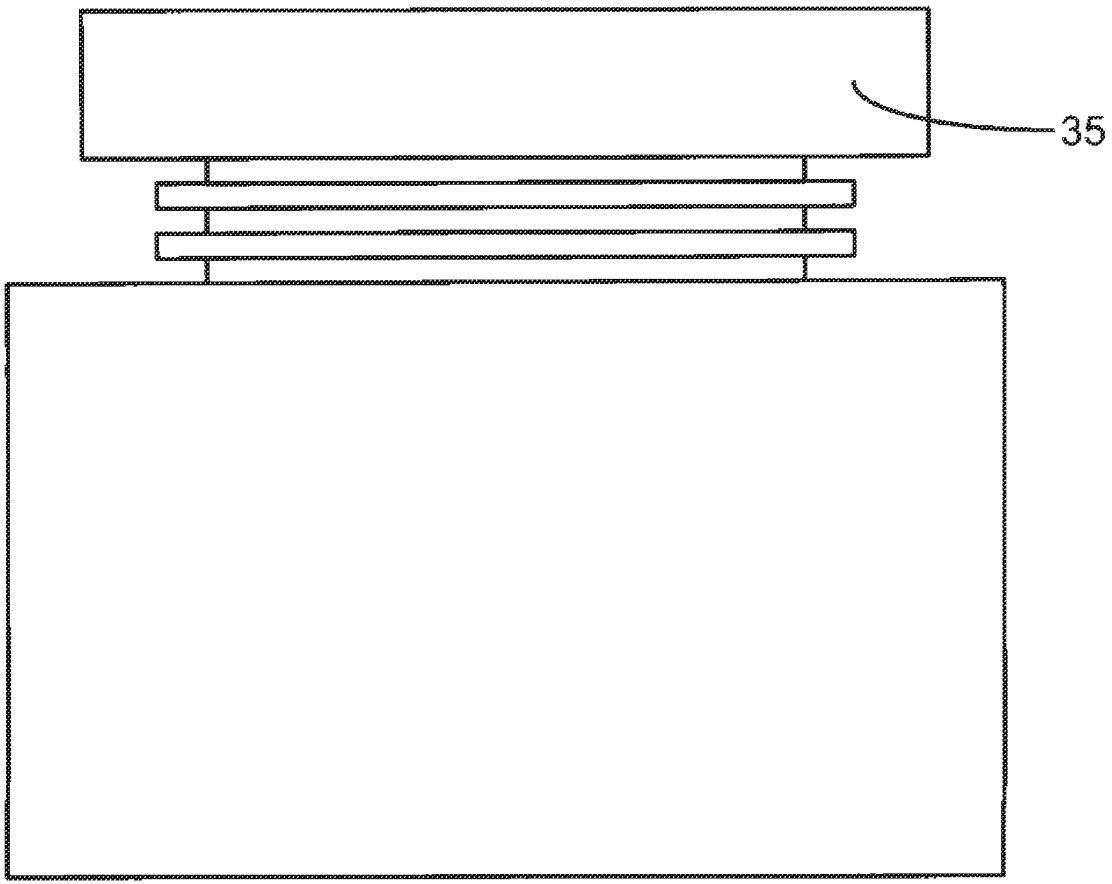
FIG. 8 is a side elevation view of a repositionable mirror included in an embodiment of the lighting device of the present invention.
Figure 9:
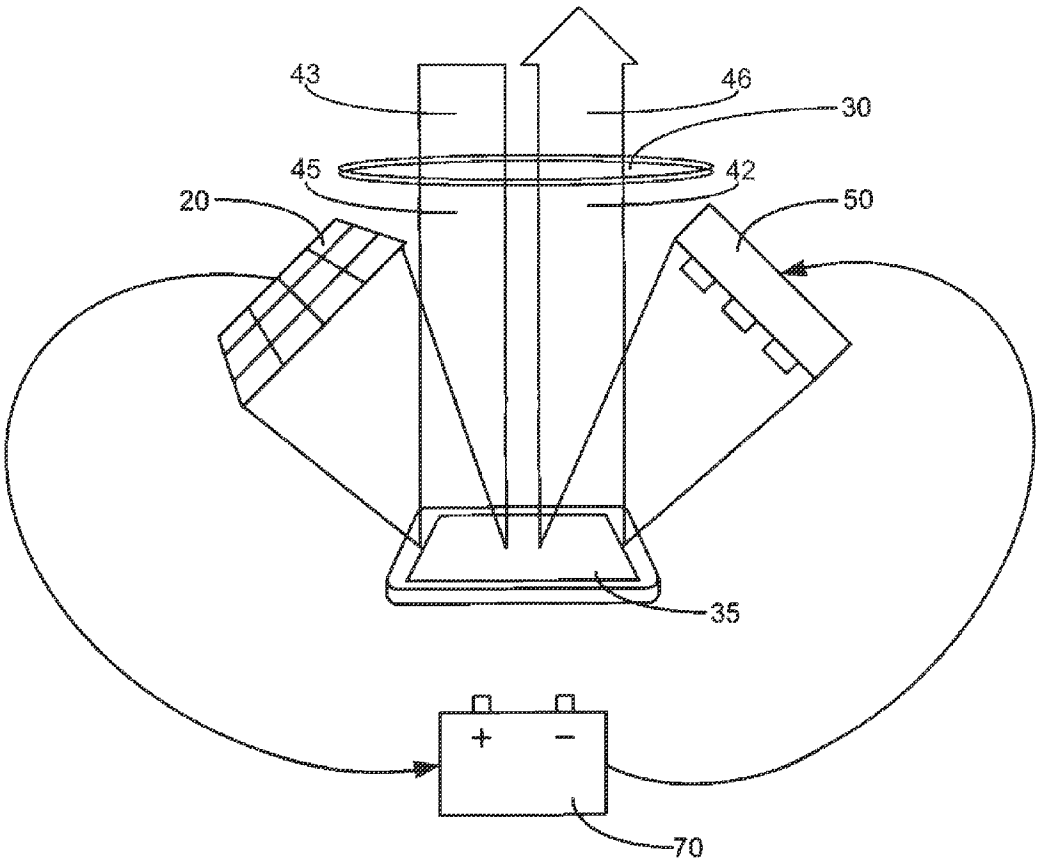
FIG. 9 is a block diagram illustrating an embodiment of the lighting device including the repositionable mirror of FIG. 8 in operation.
Figure 10:
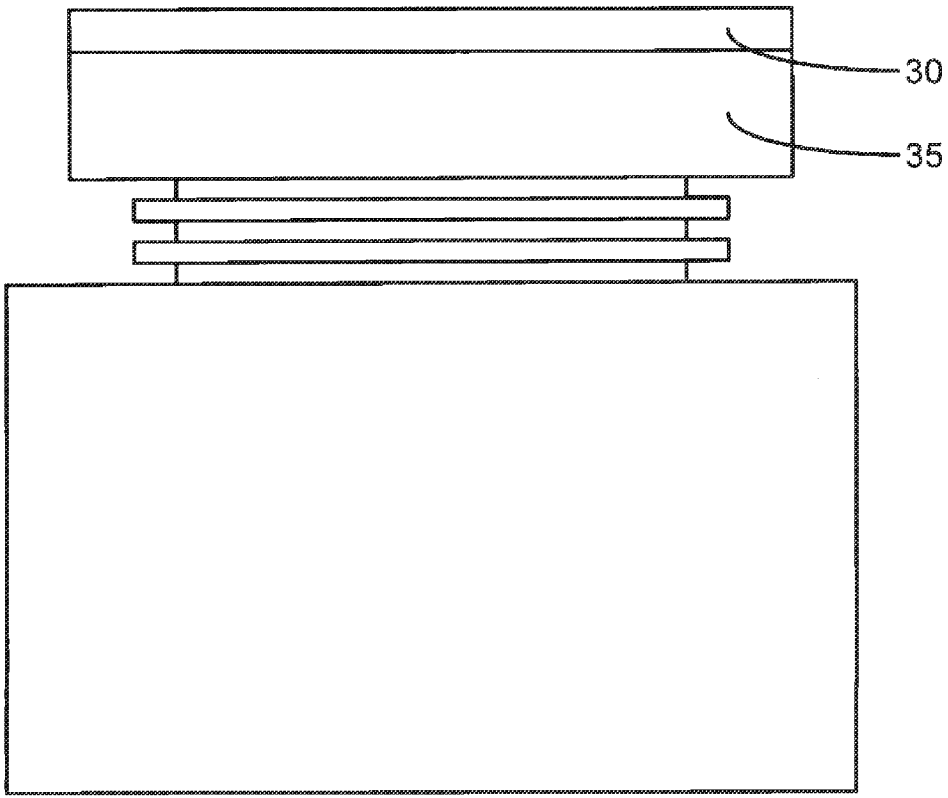
FIG. 10 is a side elevation view of the repositionable mirror of FIG. 8 with an adjacently located color conversion optic
Figure 11:
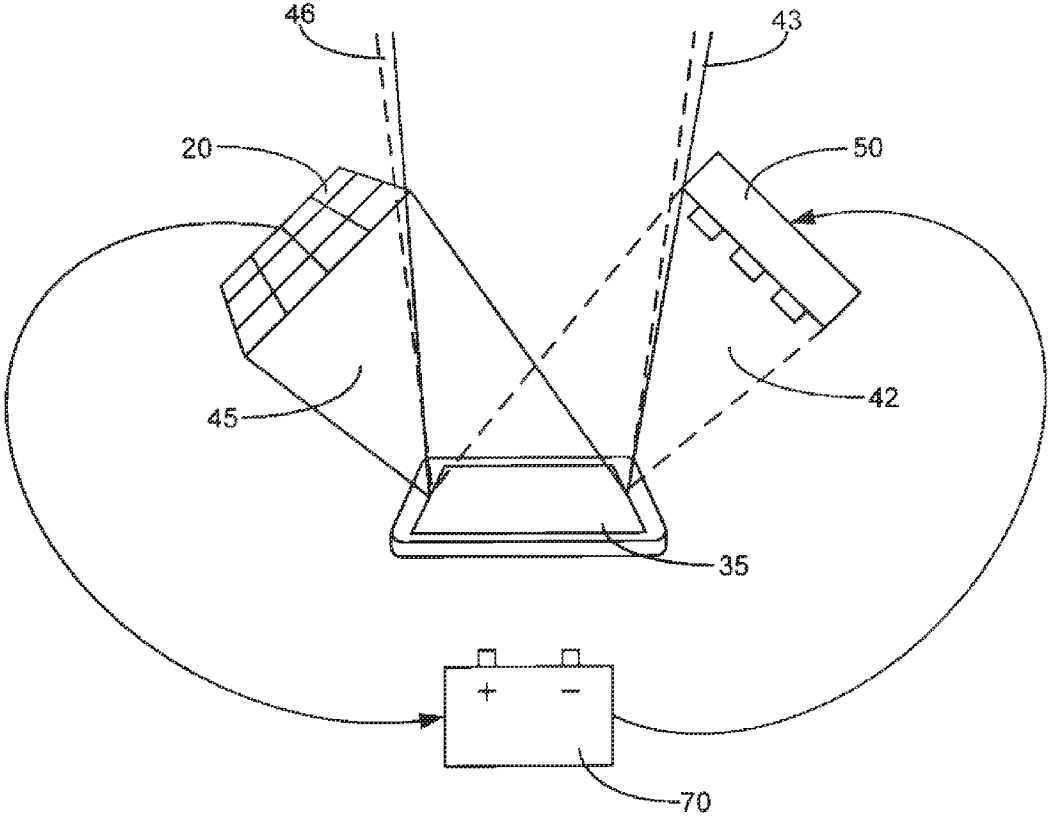
FIG. 11 is a block diagram illustrating an embodiment of the lighting device including the repositionable mirror of FIG. 10 in operation.
Figure 12:
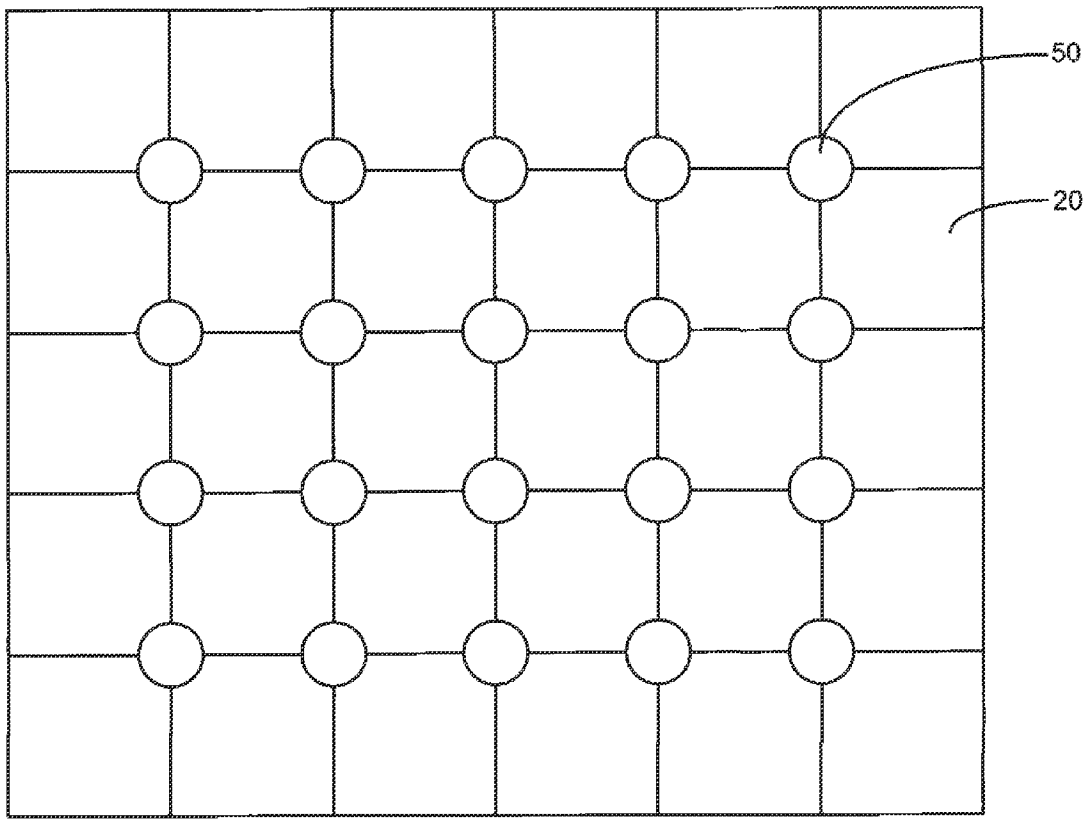
FIG. 12 top plan view of the lighting device according to an embodiment of the present invention including an adjacently located color conversion optic to allow substantially simultaneous operation in the power state and the charge state.
Figure 13:
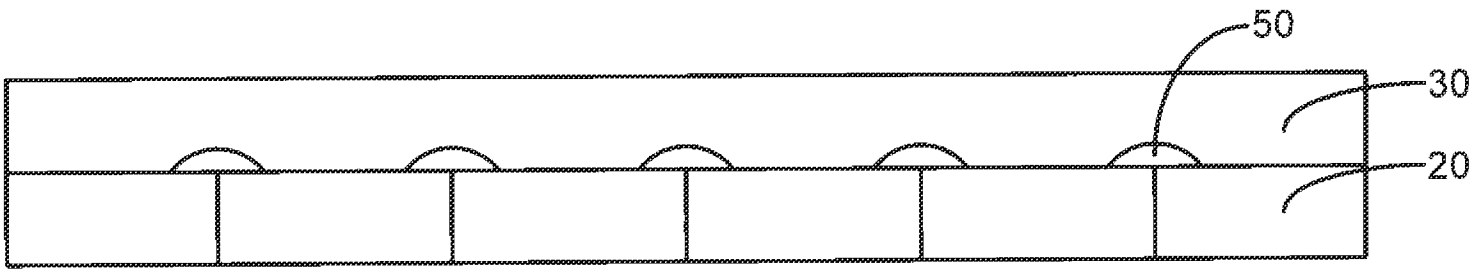
FIG. 13 side elevation view of the lighting device of FIG. 12

As illustrated in FIGS. 8-9, the color conversion optic 30 (not shown in FIG. 8) may be located between to the light source 40 and the repositionable mirror 35. Similarly, the color conversion optic 30 may be located between the repositionable mirror 35 and the desired output direction 60. Alternatively, as illustrated in FIGS. 10-11, the color conversion optic 30 may be located adjacent to the repositionable mirror 35, wherein light may be converted and reflected in approximately the same operation. A person of skill in the art will appreciate additional locations for a color conversion optic 30 in a lighting system 10, according to embodiments of the present invention, wherein a repositionable mirror 35 may be included, such as, for example, between the repositionable mirror 35 and the photovoltaic system 20 and/or lighting element 50.

The repositionable mirror 35 may be included in an array of mirrors, which may each selectively or collectively reflect light in a desired direction. The repositionable mirrors 35 included in the array or mirrors may be micromirrors. Additionally, the micromirrors may be included in a microelectromechanical system (MEMS). The MEMS device may be further described in U.S. patent application Ser. No. 13/073,805 to Maxik, et al., the entire contents of which is incorporated herein by reference.

The color conversion optic 30 may preferably include a phosphorous or quantum dot material capable of converting a light with a source wavelength range into a light with one or more converted wavelength ranges. However, it will be appreciated by skilled artisans that any material that may be capable of converting a light from one wavelength range to another wavelength range may be applied or located adjacent to the color conversion optic 30 and be included within the scope and spirit of embodiments of the present invention.

A conversion material, such as a material based on a phosphorous material, may alter the wavelength range of light that may be transmitted through the material. A source wavelength range may be converted into one or more converted wavelength range. A light within a source wavelength range, such as, for example, a solar light 43 or an illuminating light 42, may include a monochromatic, bichromatic, or polychromatic light emitted by one or more light sources, which will be discussed in greater detail later in this disclosure. For the sake of clarity, references to a light within a source wavelength range should be understood to include the light emitted by the one or more light sources. Correspondingly, a source wavelength range should be understood to be inclusive of the wavelength ranges included in monochromatic, bichromatic, and polychromatic light sources.

Additionally, a light with a source wavelength range may be converted by the conversion material, which may be applied to the color conversion optic 30, into a light with one or multiple converted wavelength ranges. The use of multiple phosphor and/or quantum dot elements may produce a light that includes multiple discrete or overlapping wavelength ranges. These wavelength ranges may be combined to produce the light within the converted wavelength ranges, such as the powering light 45 and/or the converted light 46. For clarity in the foregoing description, references to a light within converted wavelength ranges should be understood to include all wavelength ranges that may have been produced as a light within a source wavelength range may pass through the color conversion optic 30.

A phosphor substance may be illuminated when it is energized. Energizing of the phosphor may occur upon exposure to light, such as the solar light 43 emitted from the light source 40 and/or the illuminating light 42 emitted from the lighting element 50. The wavelength of light emitted by a phosphor may be dependent on the materials from which the phosphor is comprised. Typically, phosphors may convert a light within a source wavelength range into a light within a wide converted wavelength range, as will be understood by skilled artisans.

A quantum dot substance may also be illuminated when it is energized. Energizing of the quantum dot may occur upon exposure to light, such as the solar light 43 emitted from the light source 40 and/or the illuminating light 42 emitted from the lighting element 50. Similar to a phosphor, the wavelength of light emitted by a quantum dot may be dependent on the materials from which the quantum dot is comprised. Typically, quantum dots may convert a light within a source wavelength range into a light within a narrow converted wavelength range, as will be understood by skilled artisans.

For clarity, the following non-limiting example is provided wherein the color conversion optic 30 may be coated with a red conversion material, which may include a red silicate phosphorous conversion material. The present example is provided with respect to the conversion of an illuminating light 42 emitted by a lighting element 50 into a converted light 46. However, a person of skill in the art will appreciate similar structure and operation as the following example may be applied to a solar light 43 or other source light.

In this example, the lighting element 50 may include one or more blue LED. A red silicate conversion material may be evenly distributed on the color conversion optic 30, which may be located in line between the lighting element 50 and the desired output direction 60. The uniform application of the conversion material may result in the uniform conversion of blue illuminating light 42, transmitted through the color conversion optic 30, into white converted light 46. A person of skill in the art will appreciate that the application of a non-uniform conversion material to the color conversion optic 30 shall additionally be included within the scope and spirit of embodiments of the present invention.

The creation of white light may be accomplished by combining the converted light 46, which may have been converted by the color conversion optic 30 with the illuminating light 42. The illuminating light 42 may be within a source wavelength range, including a high intensity of light defined within the visible spectrum by short wavelengths, such as blue light. The converted light 46 may be within a converted wavelength range, including a high intensity of light defined within the visible spectrum by long wavelengths, such as red or yellow light. By combining the light defined by short and long wavelength ranges within the visible spectrum, such as blue and red light, respectively, an approximately white light may be produced.

The preceding example, depicting a red silicate coated color conversion optic 30, is not intended to be limiting in any way. Instead, the description for the preceding example has been provided for illustrative purposes, solely as a non-limiting example. A skilled artisan will appreciate that any wavelength range, and therefore any corresponding color, may be produced by a color conversion optic 30 located between a light generating element and the element or space at which the light may be directed. Thus, the lighting device 10, according to an embodiment of the present invention, should not in any way be limited by the conversion material described the preceding example.

A person of skill in the art, after having the benefit of this disclosure, will appreciate conversion materials that may produce light in a wavelength range other than red or yellow may be applied to the color conversion optic 30. These additional conversion materials are intended to be included within the scope and spirit of embodiments of the present invention. A skilled artisan will additionally realize that any number of conversion materials, which may be capable of producing light within various converted wavelength ranges and corresponding colors, may be applied to the color conversion optic 30 and still be included within the scope of this disclosure.

Referring now to FIGS. 1, 5-7, 9, 11, and 16, a battery 70, which may be included in the lighting device 10, according to an embodiment of the present invention, will now be discussed. The battery 70 may be included as an intermediary element located between the photovoltaic system 20 and the lighting element 50, to receive and store electrical power 49. The battery 70 may be operatively connected to both the photovoltaic system 20 and lighting element 50 such that electrical power 49 may be conducted through the connection to and from each device. Such operative connections may include, but should not be limited to, electrical cables, copper wiring, printed circuit boards, or other connections that may transmit electrical power 49. The battery 70 may also be connected to the controller 61, which may control the flow of electrical power 49 through switches or an interface, such as the I/O interface 66.

A battery 70 is a device that may accept electrical power 49. The battery 70 may also convert the electrical power 49 into a medium that may store the energy of the electrical power 49. The battery 70 may additionally convert the electrical storage medium into electrical power 49 to deliver to a connected electrical device, such as the lighting element 50. The electrical storage medium may include one or more chemical, which may be used to store the electrical energy in electrochemical cells, as will be appreciated by a person of skill in the art. Preferably, the battery 70 may be operated through many charge and discharge cycles. In addition to chemical energy storage media, a person of skill in the art will appreciate additional energy storage media to store energy, such as, but not limited to, flywheels, springs, coils, or other energy storage devices.

As perhaps best illustrated in FIGS. 1, 5, and 14-15, for example, the lighting device 10, according to an embodiment of the present invention, may include a lighting element 50 to emit an illuminating light 42. The lighting element 50 may include light emitting diodes (LEDs) capable of emitting light in a source wavelength range. The lighting element may also produce an illuminating light 42 using a laser driven lighting element 50. Those skilled in the art will appreciate that the lighting element 50 may be provided by any number of lighting elements 50, in addition to the two aforementioned examples.

In this example of a lighting element 50, the source wavelength range may include an illuminating light 42 emitted in blue or ultraviolet wavelength ranges. However, a person of skill in the art, after having the benefit of this disclosure, will appreciate that LEDs capable of emitting light in any number of wavelength ranges may be used in the lighting element 50. A skilled artisan will also appreciate, after having the benefit of this disclosure, additional light generating devices that may be included in the lighting element 50 capable of creating an illumination.

The blue spectrum may include light with a wavelength range between about 400 and 500 nanometers. An illuminating light 42 in the blue spectrum may be generated by a light emitting semiconductor comprised of materials that emit light in the blue spectrum. Examples of such light emitting semiconductor materials may include, but are not intended to be limited to, zinc selenide (ZnSe) or indium gallium nitride (InGaN). These semiconductor materials may be grown or formed on substrates, which may be comprised of materials such as sapphire, silicon carbide (SiC), or silicon (Si). A person of skill in the art will appreciate that, although the preceding semiconductor materials have been disclosed herein, any semiconductor device capable of emitting a light in the blue spectrum is intended to be included within the scope of embodiments of the present invention.

Additionally, as previously discussed, embodiments of the present invention may include a lighting element 50 that generates illuminating light 42 with a source wavelength range in the ultraviolet spectrum. The ultraviolet spectrum may include light with a wavelength range between about 200 and 400 nanometers. An illuminating light 42 in the ultraviolet spectrum may be generated by a light emitting semiconductor comprised of materials that emit light in the ultraviolet spectrum. Examples of such light emitting semiconductor materials may include, but are not intended to be limited to, diamond (C), boron nitride (BN), aluminum nitride (AlN), aluminum gallium nitride (AlGaN), or aluminum gallium indium nitride (AlGaInN). These semiconductor materials may be grown or formed on substrates, which may be comprised of materials such as sapphire, silicon carbide (SiC), or Silicon (Si). A person of skill in the art will appreciate that, although the preceding semiconductor materials have been disclosed herein, any semiconductor device capable of emitting a light in the ultraviolet spectrum is intended to be included within the scope of embodiments of the present invention.

The lighting element 50, according to an embodiment of the present invention, may include an organic light emitting diode (OLED). An OLED may be a comprised of an organic compound that emits light when an electric current is applied. The organic compound may be positioned between two electrodes. Typically, at least one of the electrodes may be transparent.

The color conversion optic 30 may produce a converted light 46 biologically affective wavelength range, or a wavelength range that triggers a psychological response within the human brain. These organic wavelength ranges may include one or more wavelength ranges that trigger positive psychological responses. As a result, the brain may increase the production of neurological chemicals, such as, for example, melatonin. The positive psychological responses may be similar to those realized in response to natural light or sunlight.

A person of skill in the art will appreciate that the lighting element 50 may emit an illuminating light 42 that is monochromatic, bichromatic, or polychromatic, similar to the powering light received by the photovoltaic system 20, as previously discussed in this disclosure. A monochromatic light is a light that may include one wavelength range. A bichromatic light is a light that includes two wavelength ranges, and may be derived from one or two lighting elements 50. A polychromatic light is a light that may include a plurality of wavelength ranges, which may be derived from one or more lighting elements 50. According to an embodiment of the present invention, the lighting device 10 may include a monochromatic light, but a person of skill in the art will appreciate bichromatic and polychromatic lighting elements 50 to be included within the scope of the present invention.

Figure 16:
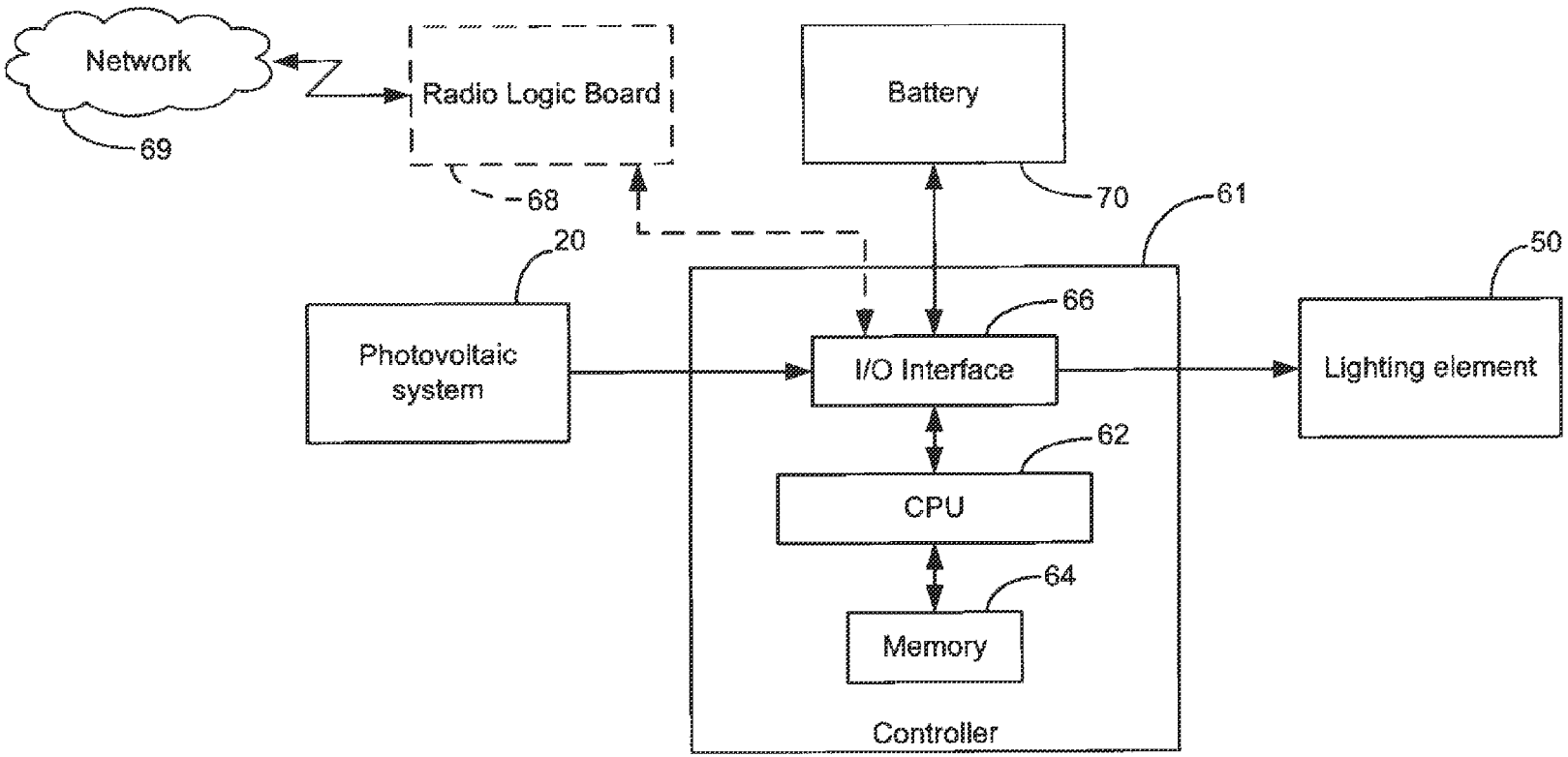
FIG. 16 is a block diagram of a controller included in the lighting device according to an embodiment of the present invention.

As illustrated in FIG. 16, a controller 61 may be included as a component of the lighting device 10, according to an embodiment of the present invention. The controller 61 may include a CPU 62, memory 64, and an input/output (I/O) interface 66. The CPU 62 may compute and perform calculations to information and data received by the additional components. As a non-limiting example, the CPU 62 may receive feedback from sensors, such as, for example, light sensing elements or timers, from which the controller may receive the feedback.

Provided as a non-limiting example, the CPU 62 may analyze sensory information and data received by the sensors and timers to determine whether the color conversion optic 30 should be located adjacent to the photovoltaic system 20 or the lighting element 50. As will be understood by a person of skill in the art, sensory information and data may be transmitted from one or more sensor, or timer, to the controller 61 as an electronic signal. The electronic signal may be received and analyzed by the controller to determine the contents of the sensory information and data.

Additionally, in the interest of clarity of this disclosure, sensory information may generally refer to an electronic communication received from a sensor. Similarly, data may generally refer to an electronic communication received by a timer. However, a skilled artisan will appreciate that sensory information may be a type of data communication, and similarly, that data may be used to define sensory information. Thus, the receipt of sensory information and data by the controller should be viewed such that is non-limiting.

The controller 61 may also include memory 64. The memory 64 may include volatile and non-volatile memory modules. Volatile memory modules may include random access memory (RAM), which may temporarily store data and code being accessed by the CPU 62. The non-volatile memory 64 may include flash based memory 64, which may store the computerized program that may be operated on the CPU 62 and sensory information, which may be received by the sensors, during operation of the lighting device 10.

Additionally, the memory 64 may include the computerized code used by the CPU 62 to control the operation of the lighting device 10. The memory 64 may also store feedback information related to the operation of additional components included in the lighting device 10. In an embodiment of the present invention, the memory 64 may include an operating system, which may additionally include applications that may be run from within the operating system, which would be appreciated by a person of skill in the art.

The controller 61 may also include an I/O interface 66. The I/O interface 66 may control the receipt and transmission of data between the controller 61 and additional components. Provided as a non-limiting example, the I/O interface 66 may receive a data communication signal, including sensory information, from sensors and/or timers. After the CPU 62 has performed an analysis, the I/O interface 66 may transmit a control signal to a component. The control signal may be used, for example, to modify the position of the color conversion optic 30, such as by using an electromechanical system.

Additionally, the controller 61 may control the direction that electrical power 49 may flow as it may be transmitted between the photovoltaic system 20, battery 70, light element 50, controller 61, and additional components of the lighting device 10, according to an embodiment of the present invention. The controller 61 may control the flow of electrical power 49 directly through the I/O interface 66. Alternatively, the controller 61 may connect to as switch, or servomechanism, to control the flow of electrical power 49. The switch or servomechanism may be controlled by the controller 61, for example, through the I/O interface 66. A person of skill in the art will appreciate additional operative connective structures through which the controller 61 may control the flow of electrical power 49 to be included within the scope of embodiments of the present invention.

An electromechanical system may be defined as a system that converts electrical energy, such as the electrical power 49 stored by the battery 70, into mechanical motion. In an embodiment of the present invention, an electromechanical system may receive a control signal from the controller 61. The electromechanical system may convert the control signal into a controlled physical motion. More specifically, the electromechanical system may use the control signal to generate the physical motion via a piston, rotating member, motor, servo-actuator, or other electrically powered, motion generating device.

Electrical signals may include various signal characteristics, which may result in various corresponding physical motions performed by the electromechanical system. The electrical signal may be digital. Digital signals may transmit a control signal from the controller 61 to be interpreted by the electromechanical system. The electromechanical system may then generate the physical motion in response to the interpreted digital signal. Alternatively, the electrical signal may be analog. Analog signals may transmit a varied voltage or current. The varied voltage or current transmitted in the analog signal may be used to control the amount of physical motion created by the electromechanical system. A person of skill in the art will appreciate additional control signals to be included within the scope and spirit of embodiments of the present invention.

The controller 61 may optionally be connected to a radio logic board 68, through which the controller 61 may communicate with additional devices via a network 69. The controller 61 may connect to the radio logic board 68, for example, through the I/O interface 66, which may be included within the controller 61. A person of skill in the art will appreciate additional locations for the radio logic board 68, which may allow the radio logic board 68 to communicate with a network 69, to be included within the scope and spirit of embodiments of the present invention. Through the network, the radio logic board 68 may allow the controller 61 to communicate with additional electronic devices, such as a computerized device, mobile computing device, or remotely located controller 61.

The radio logic board 68 may additionally be operatively connected to one or more antenna. Through the antenna, data may be included in a communication signal, which may be broadcasted and/or received by the radio logic board 68, and thus the operatively connected controller 61. A person of skill in the art will appreciate that the radio logic board 68 may communicate with a network connected device through a wired or wireless network 69. A wireless network 69 may include, but should not be limited to, a radio network, infrared network, or other wireless communication network.

The memory 64 of the controller 61 may be programmed or manipulated by an external device over the network 69. The programming or manipulation of the memory 64 may, for example and without limitation, allow the lighting device 10 to alter the a plurality of parameters, such as sensitivity of an included sensor, timing settings of an included timer, or the rate at which energy may be stored or released by the battery 70. The inclusion of a radio logic board 68 in an electronic lighting device 10 has been described in greater detail in U.S. Patent Application 61/486,314 to Holland, et al., the entire contents of which is incorporated herein by reference.

Referring now to FIGS. 1, 9, 11, and 14-15, additional features of the lighting device 10, according to an embodiment of the present invention, are now described in greater detail. More specifically, the desired output direction 60 to be illuminated with the converted light 46 will now be discussed. For example, after an illuminating light 42 has been converted by the color conversion optic 30 into a converted light 46, it may be directed to illuminate a desired output direction 60. The converted light 46 may optionally be reflected by a fixture before it may be directed in the desired output direction 60. The lighting device 10, according to an embodiment of the present invention, may emit the converted light 46 generally to diffuse into the desired output direction 60. The converted light 46 emitted by the lighting device 10 may thus illuminate a space in the desired output direction 60.

The emission of light using a light emitting semiconductor, such as an LED, will now be discussed in greater detail. An LED may emit light when an electrical current is passed through the diode in the forward bias. The LED may be driven by the electrons of the passing electrical current to provide an electroluminescence, or emission of light. The color of the emitted light may be determined by the materials used in the construction of the light emitting semiconductor. The present description contemplates the use of semiconductors that may emit a light in the blue or ultraviolet wavelength range. However, a person of skill in the art will appreciate that light may be emitted by light emitting semiconductors of any wavelength range and remain within the breadth of embodiments of the invention, as disclosed herein. Effectively, a light emitting semiconductor may emit an illuminating light 42 in any wavelength range, since the emitted illuminating light 42 may be subsequently converted by a color conversion optic 30 located adjacent to the lighting element 50, prior to illuminating a volume.

Figure 17:
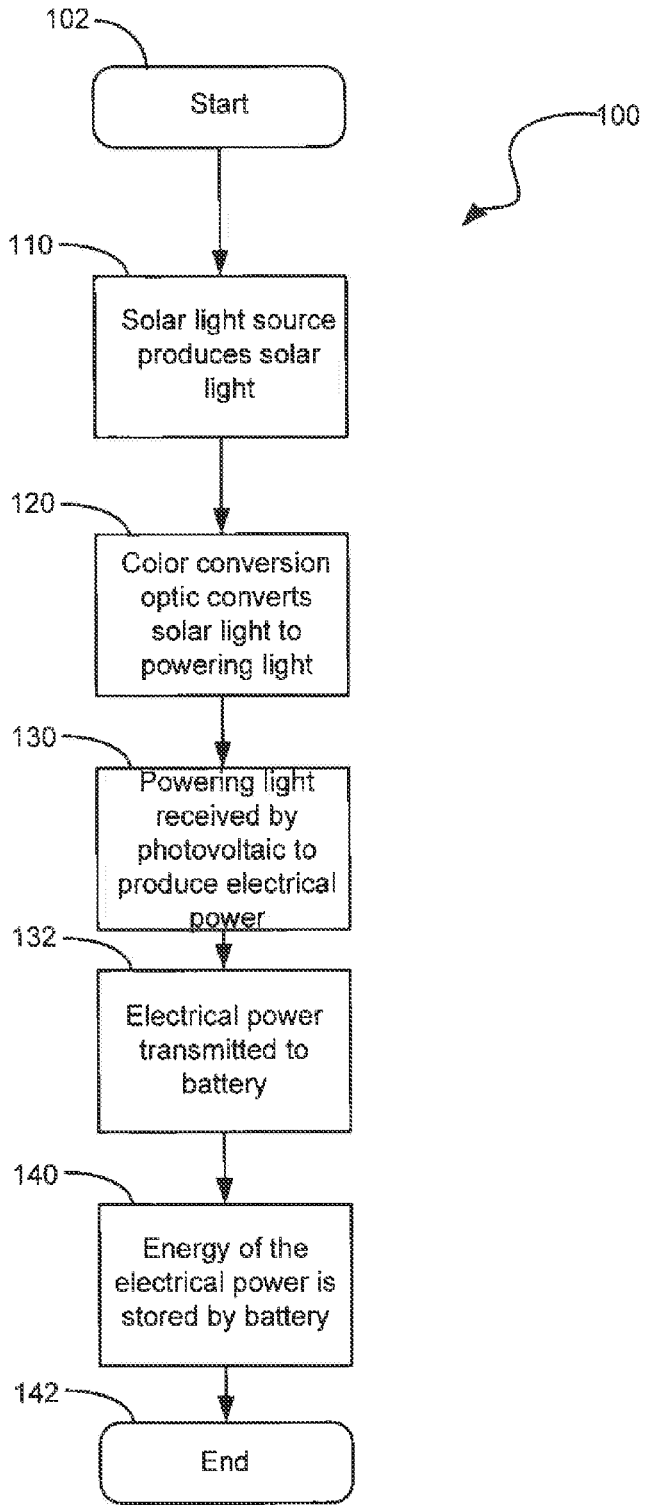
FIG. 17 is a flowchart illustrating the receipt of powering light as converted by a color conversion optic, according to an embodiment of the lighting device of the present invention.
Figure 18:
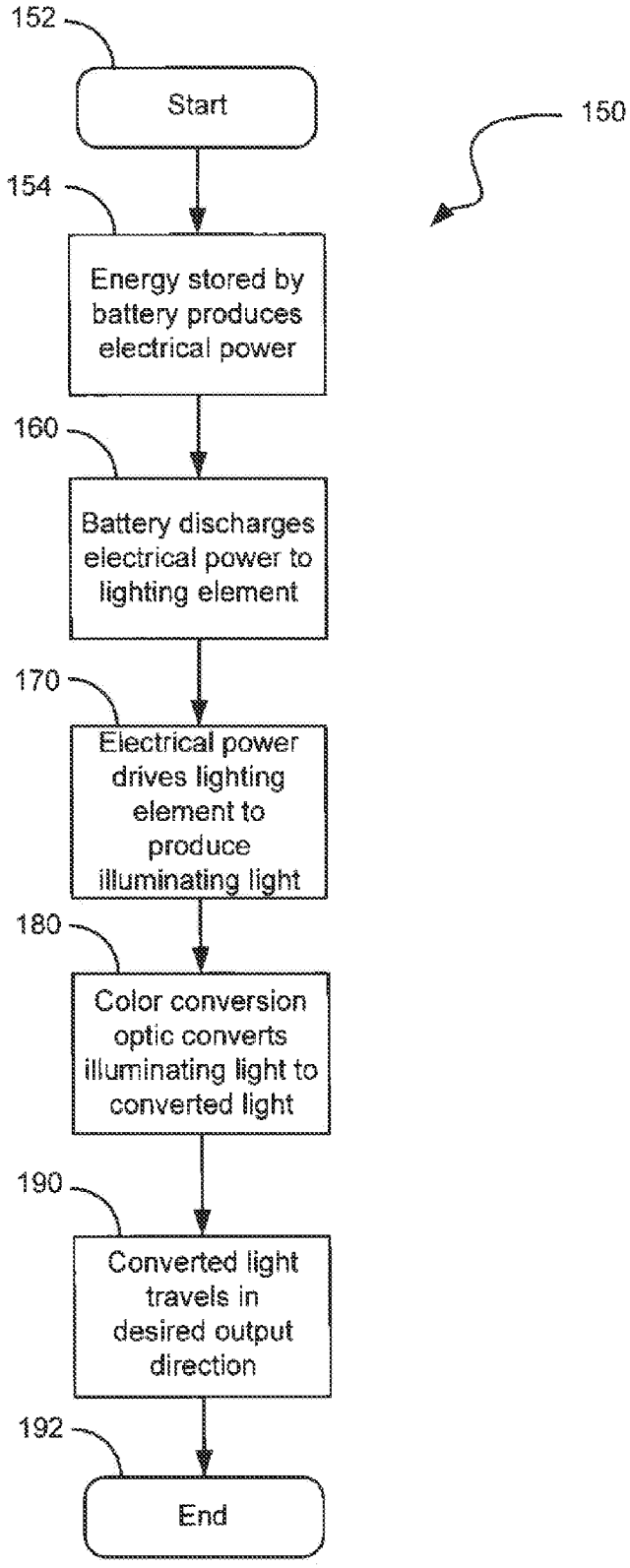
FIG. 18 is a flowchart illustrating the emission of illuminating light to be converted by a color conversion optic, according to an embodiment of the lighting device of the present invention.
Figure 19:
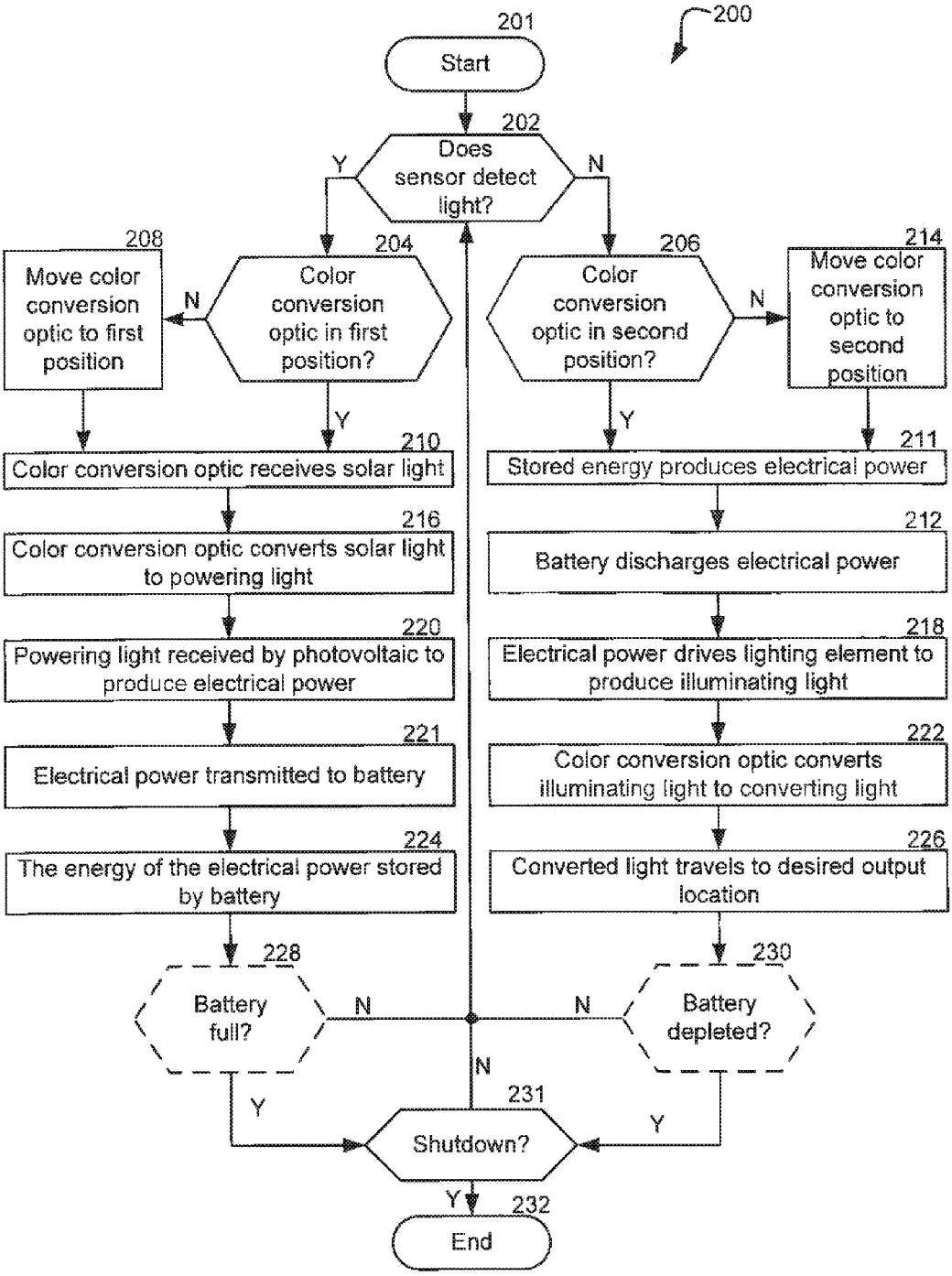
FIG. 19 is a flowchart illustrating the operations of FIGS. 17-18 further including a sensor, according to an embodiment of the lighting device of the present invention.

Referring now to FIGS. 17 and 18, example method operations of the lighting device 10, according to an embodiment of the present invention, will now be discussed. A person of skill in the art will appreciate that the operations illustrated in FIGS. 17 and 18 describe operations performed by the lighting device 10, as it may operate in the charge state 84 and the power state 82, respectively. Although the two color conversion operations are illustrated separately, the color conversion operations should be considered by a skilled artisan collectively as the operation of the lighting device 10, according to embodiments of the present invention.

Referring now to flowchart 100 of FIG. 17, along with FIG. 4, an illustrative charging operation of the lighting device 10, according to an embodiment the present invention, will now be discussed. Starting at Block 102, the light source 40 may produce solar light 43 (Block 110). The solar light 43 may then be received by a color conversion optic 30, wherein the solar light 43 may be converted to powering light 45 (Block 120). The photovoltaic system 20 may then receive powering light 45 from the color conversion optic 30, which may be used to produce electrical power 49 (Block 130). The production of electrical power 49 from a photovoltaic system 20 has previously been described in greater detail above. The electrical power 49 may then be transmitted to a battery 70 (Block 132). The energy of the electrical power may then be stored in the battery (Block 140). The charging operation may then terminate at Block 142.

Figure 15:
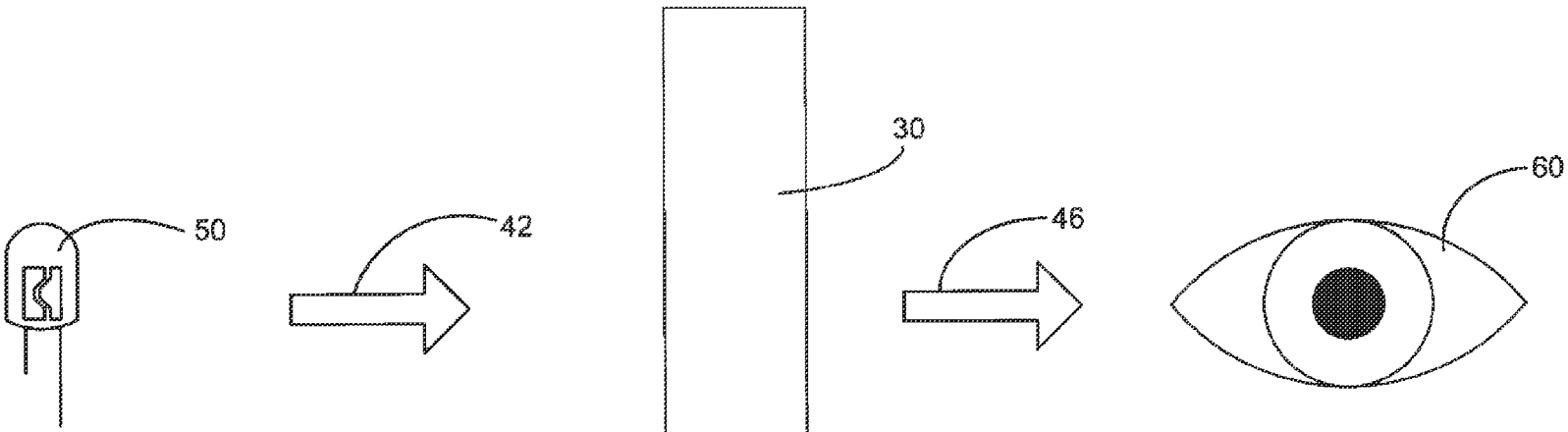
FIG. 15 is a block diagram of a lighting element emitting illuminating light to be converted by a color conversion optic, according to an embodiment of the lighting device of the present invention

Referring now to flowchart 150 of FIG. 18, along with FIG. 15, an illustrative powering operation of the lighting device 10, according to an embodiment of the present invention will now be discussed. Starting at Block 152, the energy stored in a battery 70 may produce electrical power 49 (Block 154). The battery 70 may discharge the electrical power 49 to the lighting element 50 (Block 160). The electrical power 49 may be used to drive the lighting element 50, producing illuminating light 42 (Block 170). The illuminating light 42 may then be received by the color conversion optic 30, wherein it may be converted to a converted light 46 (Block 180). Converted light 46 may then be directed in a desired output direction 60 (Block 190). The powering operation may then terminate at Block 192.

A person skilled in the art may note that, while the charging and powering operations previously outlined have many useful advantages operating separately, and may not necessarily be combined, there is great advantage in combining charging and powering operations as well. Flowchart 200 of FIG. 19 outlines an embodiment of the present invention combining the charging and powering operations. In this example, operation between the charging state and powering state may be determined by a light detection sensor.

Starting at Block 201, a sensor may determine whether light is detected (Block 202). A person of skill in the art will appreciate that the sensor may detect a plethora of conditions, in addition to the presence of visible light, to the controller 61 to control operation of the lighting device 10 as sensory information. Therefore, skilled artisans should not limit the condition detected by the sensor to light, as described in the following example.

If light is detected by the sensor at Block 202, an embodiment the present invention may check whether the position of the color conversion optic 30 is in the first position (Block 204). If the color conversion optic 30 is in the first position, as illustrated in FIG. 4, the operation described in Block 210 may be performed and solar light 43 may be received. If the color conversion optic 30 is not in the first position, as illustrated in FIG. 3, the color conversion optic may be moved into the first position (Block 208). Once moved into the first position, the color conversion optic 30 may receive solar light 43 (Block 210). The solar light 43 may then be converted by the color conversion optic 30 into powering light 45 (Block 216). The powering light 45 may be received by photovoltaic 20, which may convert the powering light 45 to electrical power 49 (Block 220). The electrical power 49 may be transmitted to the battery at Block 221. The energy of the electrical power 49 may then be stored in a battery 70 (Block 224).

Optionally, the lighting device 10 according to an embodiment of the present invention may determine whether the batten 70 is fully charged (Block 228). This determination may be made using the controller 61. If the battery 70 is not fully charged, the lighting device 10 may return to the operation described in Block 202, wherein the sensor may continue detecting light. If the battery 70 is fully charged, it may then determine whether a shutdown command has been issued (Block 231).

Figure 14:
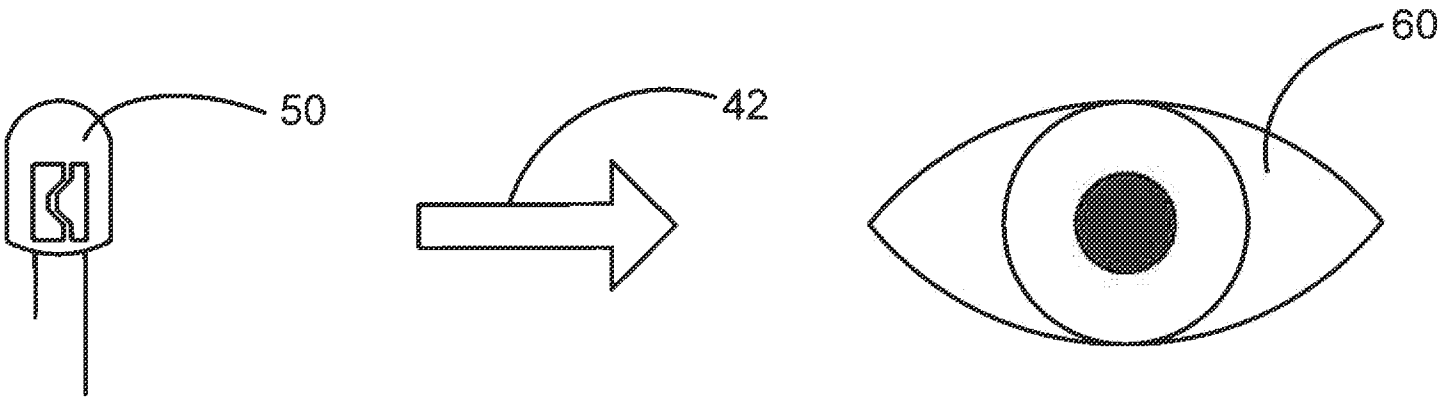
FIG. 14 is a block diagram of a lighting element emitting illuminating light toward a desired output direction, according to an embodiment of the lighting device of the present invention.

Alternatively, if the sensor does not sense light at Block 202, the lighting device 10 may determine whether the position of the color conversion optic 30 is in the second position (Block 206). If the color conversion optic is in the second position, as illustrated in FIG. 15, the operation described in Block 211 may be performed by using the energy stored in the battery 70 to produce electrical power 49. If color conversion optic 30 is not in the second position at Block 206, as illustrated in FIG. 14, the lighting device 10 may move the color conversion optic 30 to the second power position (Block 214). Once the color conversion optic 30 is in the second position, energy stored by the battery 70 may be used to produce electrical power 49 (Block 211). The battery 70 may then discharge the electrical power 49 to a lighting element 50 (Block 212). The electrical power 49 may drive the lighting element 50 to produce illuminating light 42 (Block 218). The color conversion optic 30 may receive the illuminating light 42, converting it into converted light 46 (Block 222). The converted light 46 may travel in desired output direction 60 (Block 226), illuminating a volume with light including a desired output color.

Optionally, the lighting device 10 according to an embodiment of the present invention may check whether the battery 70 is depleted (Block 230). If the battery 70 is not depleted, the lighting device 10 may return to the operation described in Block 202, wherein the sensor may continue detecting light (Block 202). If the lighting device 10 determines that the battery 70 is depleted, the lighting device 10 may determine whether a shutdown command has been issued (Block 231).

If no shutdown command is detected at Block 231 the lighting device 10 may return to the operation described in Block 202, wherein the sensor may attempt to continue detecting light. Should a shutdown command be detected at Block 231, the operation may terminate at Block 232.

Figure 20:
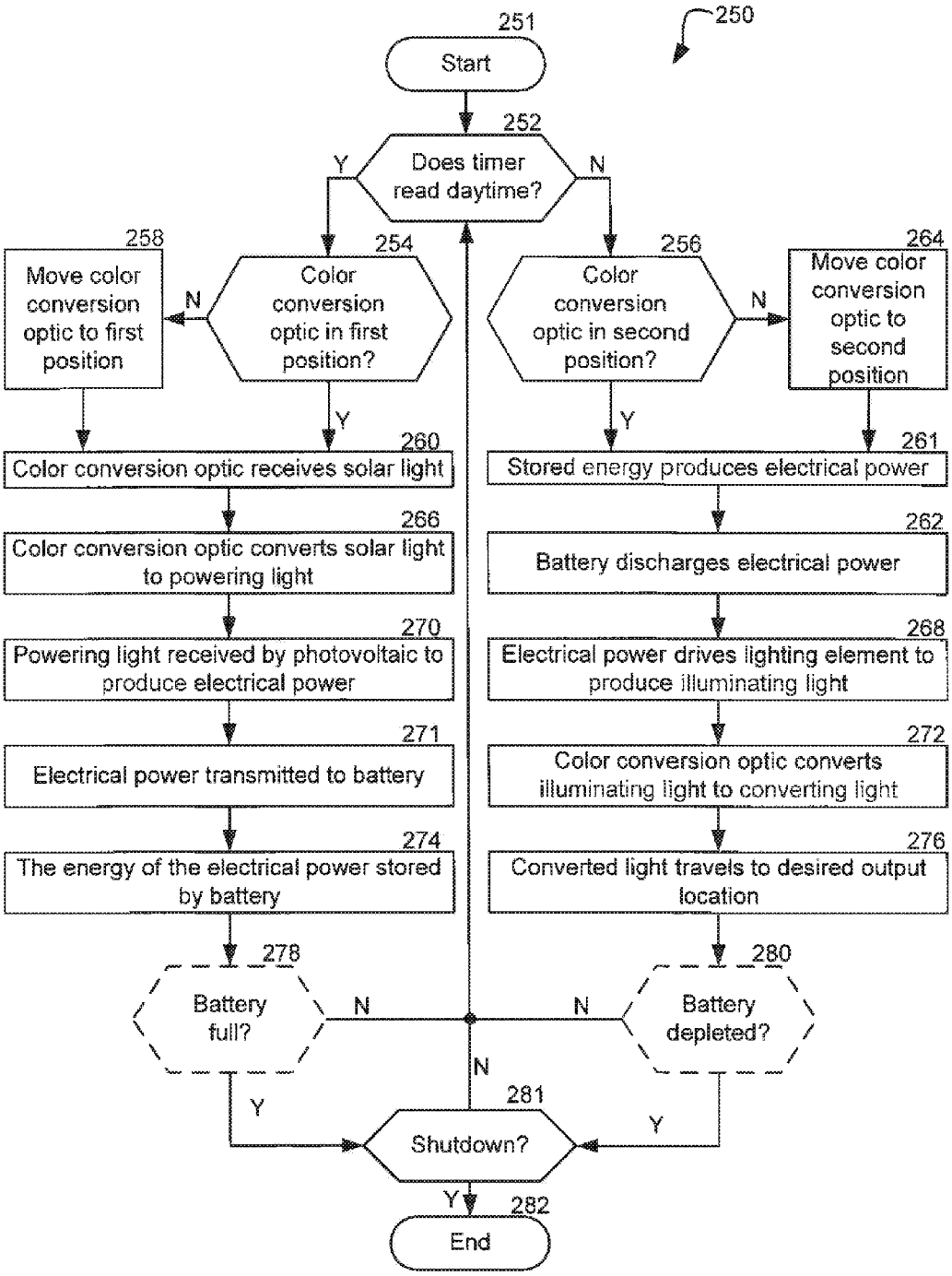
FIG. 20 is a flowchart illustrating the operations of FIGS. 17-18 further including a timer, according to an embodiment of the lighting device of the present invention.

Flowchart 250 of FIG. 20 outlines an embodiment of the present invention combining the charging and powering operations. In this example, operation between the charge state and the power state may be determined by a timer. The timer may be included in the controller 61, however a person of skill in the art will appreciate the inclusion of an external timer operatively connected to the controller 61 as included within the scope of embodiments of the present invention.

Starting at Block 251, a timer may determine whether it is daytime, which may determine whether the lighting device 10 may operate in the charge state 84 or the power state 82 (Block 252). The lighting device 10, according to an embodiment of the present invention, may then determine the position of the color conversion optic 30 of the lighting device 10 with respect to duration detected by the timer.

A person of skill in the art will appreciate that the timer may be configured to position the color conversion optic 30 to a desired position at the start of any duration. An example of such operation may include positioning the color conversion optic 30 to the charging position around about 5:00 AM, once a majority of people may enjoy the illumination of a volume may be asleep and prior to sunrise. Additionally, a clock or time sensing device may be included in the lighting device 10 as it may be described with respect to an embodiment of the present invention. As a result, skilled artisans should not limit the sensing of time to the use of a timer, as described in the following example.

If it is determined to be during the daytime hours at Block 252, an embodiment of the present invention may check whether the position of the color conversion optic 30 is in the first position (Block 254). If the color conversion optic 30 is in the first position, as illustrated in FIG. 4, an embodiment of the present invention may perform the operation described in Block 260 and receive solar light 43. If the color conversion optic 30 is not in the first position, as illustrated in FIG. 3, it may be moved into the charge position (Block 258). Once moved into the first position, the color conversion optic 30 may receive solar light 43 (Block 260). The solar light 43 may then be converted by the color conversion optic 30 into powering light 45 (Block 266). The powering light 45 may be received by photovoltaic 20, which may convert the powering light 45 to electrical power 49 (Block 270). The electrical power 49 may be transmitted to the battery at Block 271. The energy of the electrical power 49 may then be stored in a battery 70 (Block 274).

Optionally, in an embodiment of the present invention, the lighting device 10 may determine whether the battery 70 is fully charged (Block 278). This determination may be made using the controller 61. If the battery 70 is not fully charged, the lighting device 10 may return to the operation described in Block 252, wherein the timer may determine the desired position of the color conversion optic 30. If the battery 70 is fully charged, the lighting device 10, according to an embodiment of the present invention, may determine whether a shutdown command has been issued (Block 281).

Alternatively, if it is determined to be during the nighttime hours at Block 252, the lighting device 10 may determine whether the position of the color conversion optic 30 is in the second position (Block 256). If the color conversion optic is in the second position, as illustrated in FIG. 15, the current embodiment of the present invention may perform the operation described in Block 261 by using the energy stored in the battery 70 to produce electrical power 49. If color conversion optic 30 is not in the second position, as illustrated in FIG. 14, the lighting device 10 may move the color conversion optic 30 to the power position (Block 264).

Once the color conversion optic 30 is in the second position, energy stored in battery 70 may be used to produce electrical power 49 (Block 261). The battery 70 may then discharge the electrical power 49 to a lighting element 50 (Block 262). The electrical power 49 may drive the lighting element 50 to produce illuminating light 42 (Block 268). The color conversion optic 30 may receive the illuminating light 42, converting it into converted light 46 (Block 272). The converted light 46 may travel in desired output direction 60 (Block 276), illuminating a space with light of a desired output color.

Optionally, in an embodiment of the present invention, the lighting device 10 may check whether the battery 70 is depleted (Block 280). If the battery 70 is not depleted, the lighting device 10 may return to the operation described in Block 252, wherein the timer may continue determining duration (Block 252). If the lighting device 10 determines that the battery 70 is depleted, the lighting device 10, according to an embodiment of the present invention, may determine whether a shutdown command has been issued (Block 281).

If no shutdown command is detected at Block 281, the lighting device 10 may return to the operation described in Block 252, timer may determine the desired position of the color conversion optic 30. Should a shutdown command be detected at Block 281, the operation may terminate at Block 282.

Figure 21:
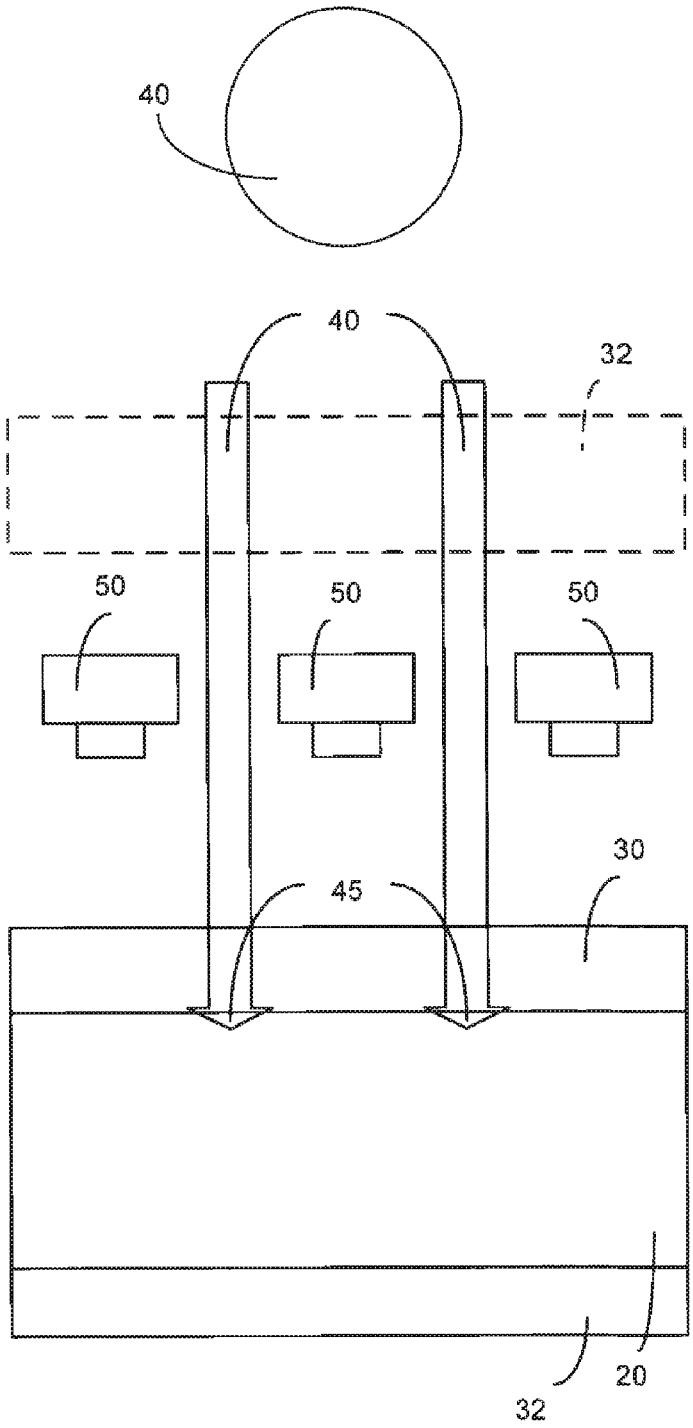
FIG. 21 is a block diagram illustrating operation in the charge state, according to an embodiment of the lighting device of the present invention.
Figure 22:
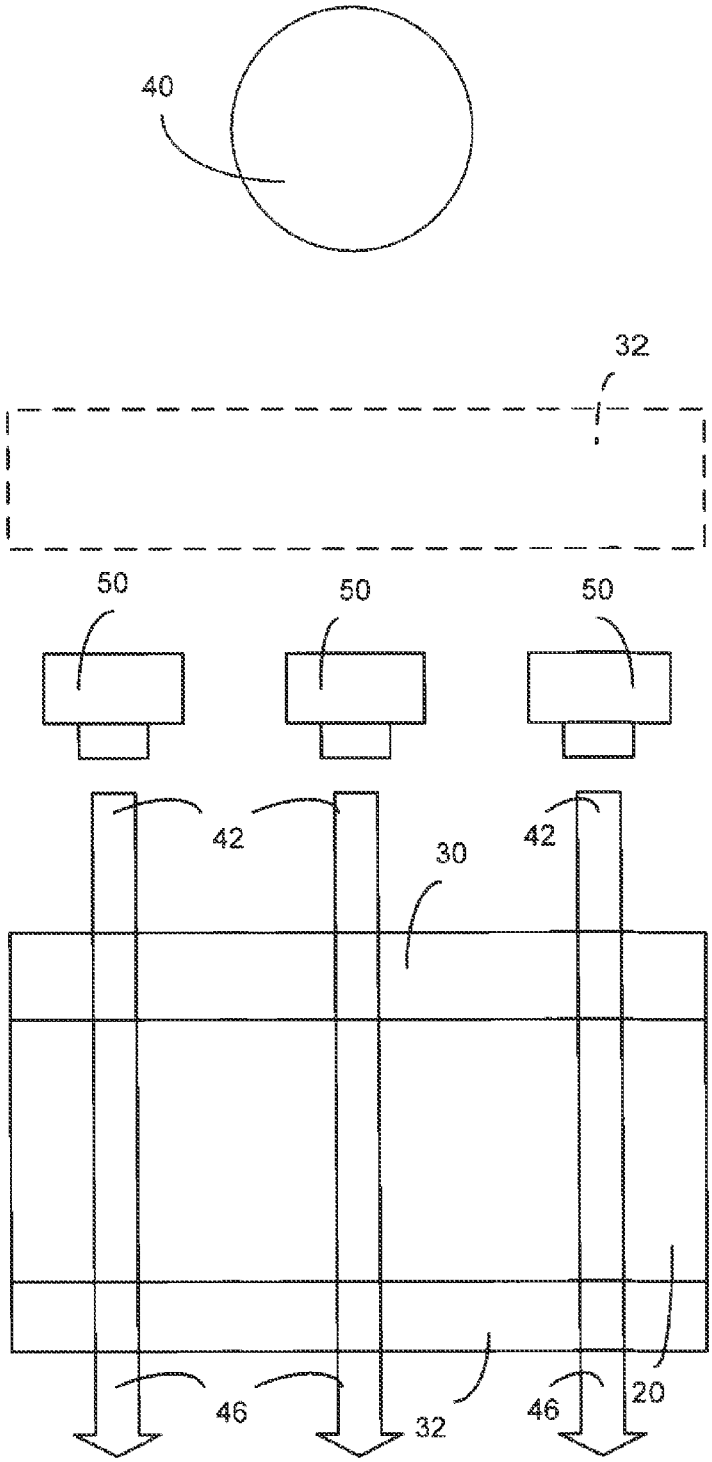
FIG. 22 is a block diagram illustrating operation in the power state, according to an embodiment of the lighting device of the present invention.
Figure 23:
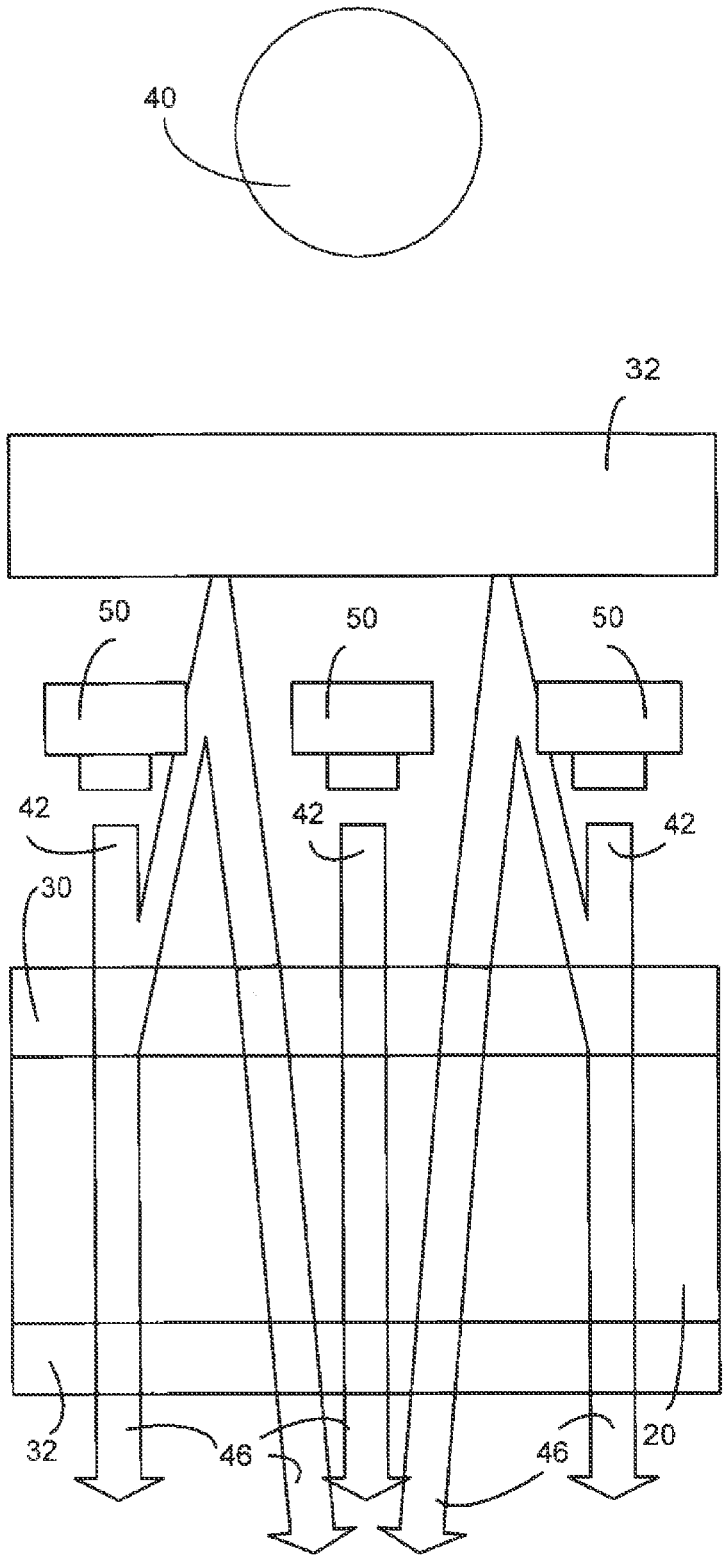
FIG. 23 is a block diagram illustrating operation in the power state, according to an embodiment of the lighting device of the present invention.

Referring now to FIGS. 21-23, additional embodiments of the lighting device 10 will now be discussed. More specifically, embodiments that include electro-optic material will now be discussed. An electro-optic material is a material, the optical properties of which may be modified in response to an applied or otherwise ambient electric field, and that may be selectable between being transparent, opaque, and/or reflective and other relative states of transparency or reflectivity. There are a numerous variety of electro-optic materials, as will be known to those skilled in the art, that could be employed with embodiments of the invention, including for example crystalline materials, polymers and other organics, nematics and the like. Moreover, embodiments of the invention are not limited to electro-optic materials, but may include any material that can have its optical properties, such as transmissivity or reflectivity, altered, including but not limited to magneto-optic and acousto-optic materials. In one embodiment electroactive indium tin oxide (ITO) may be used. The electro-optic material may be included in, or located adjacent to, an electro-active optic 32. The amount of light that may pass through the electro-active optic 32 may be controlled by manipulation of the properties of an electric field relative to the electro-optical material. The manipulation of the electric field may be controlled, for example, by the controller 61. By changing the state of the electro-optical material, and thus the electro-active optic 32, the lighting device 10 may control the operation of light emission and/or power generation.

In the following examples, a light source 40 is depicted as being located above the lighting device 10, which may be received by a top portion of the lighting device 10. Additionally, in the following examples, illuminating light 42 may be emitted in a downward direction to illuminate a space below. The illustrated directions in which light may travel have been included in the interest of clarity for discussing the following examples, and are not intended to be limiting. Those of skill in the art will appreciate additional configurations wherein light may be received and/or emitted from different angles.

The electro-active optic 32 may be comprised of Energy Glass, or another material that may be selectable between substantially transparent, opaque, and/or reflective states. Alternatively or additionally, a transparent conductor such as indium tin oxide (ITO) may be employed to provide electrical conductivity, for example, as a current collector, while allowing passage of light. One or more lighting element 50 may be located on the electro-active optic 32, wherein the lighting elements 50 may be configured to emit illuminating light 42 in a direction to illuminate a space. The electro-active optic 32 may be the substrate on which the lighting elements 50 are located, selectively allowing light to pass through the substrate. In additional embodiments, the electro-active optic 32 may include photovoltaic elements to harvest or generate at least part of the light that may pass through or be restricted by the optic. Furthermore, the photovoltaic system 20 may be comprised of one or more electro-active optics 32.

Referring now to FIG. 21, solar light 43 from a light source 40 may be received by the photovoltaic system 20 to be converted into electrical power 49. The solar light 43 may pass through a color conversion optic 30 prior to being received by the photovoltaic system 20, which may convert the solar light 43 into powering light 45. The powering light 45 may be defined by wavelength characteristics that increase the efficiency of converting light into electrical power 49. The solar light 43 may additionally pass through an optional electro-active optic 32, which may be configured to be at least partially transparent. Conversely, the optionally included electro-active optic 32 may be configured in a substantially opaque or transparent state, as to restrict the amount of solar light 43 to be received by the photovoltaic system 20.

An additional electro-active optic 32 may be included adjacent to the end of the photovoltaic system 20 opposite the light source 40, or opposite from the end of the photovoltaic system 20 that may receive the solar light 43. The electro-active optic 32 may be selectable between varying levels of transparency and reflectivity, which may be used to control the generation of electrical power 49 from the received powering light 45. For example, the electro-active optic 32 located adjacent to the photovoltaic system 20 may be controlled to reflect a substantial amount of light that has not been converted by the photovoltaic system 20 into electrical power 49. This reflection may provide an additional opportunity for power generation from the reflected powering light 45. Conversely, the electro-active optic 32 may allow at least part of the powering light 45 to pass though the optic, for example, when the demand for generation of electrical power 49 is low.

Referring now to FIG. 22, the emission of illuminating light 42 from a lighting element 50 will now be discussed according to the present embodiment. The illuminating light 42 may be emitted in a direction to illuminate a space, which may pass through an at least partially transparent substrate. Additionally, the substrate may be an electro-active optic 32, which may be selectable between transparent and non-transparent states.

The illuminating light 42 emitted by the lighting elements 50 may be received by the color conversion optic 30 located adjacent to the photovoltaic system 20. The color conversion optic 30 may convert the illuminating light 42 into converted light 46, after which it may pass through the photovoltaic system 20. An electro-active optic 32 may be located adjacent to the photovoltaic system 20 at an end opposite the lighting elements 50 and configured in a transparent state, allowing the converted light 46 to be transferred through the optic 32. An additional, optional electro-active optic 32 may be located between the lighting elements 50 and the light source 40 to control whether solar light 43 may be received by the photovoltaic system 20 while illuminating light 42 is being emitted by one or more lighting element 50.

Referring now additionally to FIG. 23, an additional example illustrating the emission of illuminating light 42 from a lighting element 50 will now be discussed. The structural construction of the embodiment illustrated in FIG. 23 may be similar to the construction of the lighting device 10 in FIG. 22. In this embodiment, the substrate may include at least partially reflective properties. These reflective properties may be selectable by the lighting device 10, or inherent to the properties of the substrate. As the lighting elements 50 may emit illuminating light 42, it may pass through a color conversion optic 30 to convert the illuminating light 42 to converted light 46. At least part of the converted light 46 may pass through the substrate of the photovoltaic system 20 to illuminate the space below.

However, part of the converted light 46 may be reflected away from the space to be illuminated and/or in a direction relatively toward the lighting elements 50. An electro-active optic 32 may be located above the lighting elements 50, which may be configured in a reflective state. A person of skill in the art will appreciate many states of opacity that may reflect at least part of the light received by the electro-active optic 32. At least part of the reflected light may the pass through the substrate of the photovoltaic system 20, advantageously decreasing the amount of light that otherwise would have been lost due to the initial reflection from the photovoltaic system 20. Light may continuously be reflected between the substrate and the electro-active optic, allowing subsequently reflected light to pass though the at least partially transparent photovoltaic system 20 and illuminate the environment below. The continually reflected light may undergo additional color conversions as it may subsequently pass through the color conversion optic 30.

Many modifications and other embodiments of the invention will come to the mind of one skilled in the art after having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A lighting device comprising:

a photovoltaic system that accepts powering light;

a lighting element in communication with a battery and that emits illuminating light;

a controller in communication with the photovoltaic system, the lighting element, and the battery; and a color conversion optic that is movable to convert a solar light to the powering light and to convert the illuminating light to a converted light;

wherein the photovoltaic system generates electrical power to be stored by the battery when the lighting device operates in a charge state, and wherein the lighting element is driven by the electrical power stored by the battery when the lighting device operates in a power state, and wherein the controller selectively enables operation between the charge state and the power state.

2. A lighting device according to claim 1 wherein the color conversion optic is movable between a first position and a second position; wherein the first position is defined as the color conversion optic being positioned adjacent to the photovoltaic system to convert the solar light to the powering light; and wherein the second position is defined as the color conversion optic being positioned adjacent to the lighting element to convert the illuminating light to the converted light.

3. A lighting device according to claim 2 further including an electromechanical device to move the color conversion optic between the first position and the second position.

4. A lighting device according to claim 1 further including a repositionable mirror to receive and reflect the solar light and to receive and reflect the illuminating light.

5. A lighting device according to claim 4 wherein the repositionable mirror is included in a microelectromechanical system (MEMS).

6. A lighting device according to claim 4 wherein the color conversion optic is positioned adjacent to the repositionable mirror.

7. A lighting device according to claim 1 wherein the color conversion optic is positioned adjacent to the photovoltaic system and the lighting element to allow substantially simultaneous operation in the charge state and power state.

8. A lighting device according to claim 1 wherein the controller includes a timer; and wherein the controller analyzes data provided by the timer to control operation between the power state and the charge state.

9. A lighting device according to claim 1 wherein the controller is communicatively connected to a sensor to receive sensory information; and wherein the controller analyzes the sensory information to control operation between the power state and the charge state.

10. A lighting device according to claim 9 wherein the sensor detects whether the solar light is present and generates the sensory information regarding presence of the solar light.

11. A lighting device according to claim 10 wherein the controller is communicatively connected to a timer; wherein the controller controls operation between the power state and the charge state based on the sensor and the timer.

12. A lighting device according to claim 1 wherein the controller is communicatively connected to a radio logic board to transmit and receive communication information; and wherein the communication information is used by the controller to control operation between the power state and the charge state.

13. A lighting device according to claim 1 wherein the lighting element is a light emitting diode.

14. A lighting device according to claim 13 wherein the light emitting diode emits the illuminating light within a wavelength range between 200 and 500 nanometers.

15. A lighting device according to claim 1 wherein the color conversion optic includes a conversion material selected from a group consisting of phosphors and quantum dots.

16. A lighting device according to claim 1 wherein the photovoltaic system is at least partially transparent.

17. A lighting device according to claim 1 further comprising an electro-active optic located adjacent to the photovoltaic system, wherein the electro-active optic is variable between being be at least partially transparent and being at least partially non-transparent.

18. A lighting device comprising:

a photovoltaic system that accepts powering light;

a lighting element in communication with a battery and that emits illuminating light;

a controller in communication with the photovoltaic system, the lighting element, and the battery;

a color conversion optic to convert a solar light to the powering light and to convert the illuminating light to a converted light; and an electromechanical device to move the color conversion optic between a first position and a second position;

wherein the photovoltaic system generates electrical power to be stored by the battery when the lighting device operates in a charge state, and wherein the lighting element is driven by the electrical power stored by the battery when the lighting device operates in a power state, and wherein the controller selectively enables operation between the charge state and the power state;

wherein the controller is communicatively connected to a sensor to receive sensory information, and wherein the controller analyzes the sensory information to control operation between the power state and the charge state;

wherein the first position is defined as the color conversion optic being positioned adjacent to the photovoltaic system to convert the solar light to the powering light;

wherein the second position is defined as the color conversion optic being positioned adjacent to the lighting element to convert the illuminating light to the converted light.

19. A lighting device according to claim 18 further including a repositionable mirror to receive and reflect the solar light, and to receive and reflect the illuminating light.

20. A lighting device according to claim 19 wherein the repositionable mirror is included in a microelectromechanical system (MEMS).

21. A lighting device according to claim 19 wherein the color conversion optic is positioned adjacent to the repositionable mirror.

22. A lighting device according to claim 18 wherein the sensor detects whether the solar light is present and generates the sensory information regarding presence of the solar light.

23. A lighting device according to claim 18 wherein the controller is communicatively connected to a radio logic board to transmit and receive communication information; and wherein the communication information is used by the controller to control operation between the power state and the charge state.

24. A lighting device according to claim 18 wherein the controller includes a timer; wherein the controller analyzes data provided by the timer to control operation between the power state and the charge state.

25. A lighting device according to claim 18 wherein the lighting element is a light emitting diode.

26. A lighting device according to claim 25 wherein the light emitting diode emits the illuminating light within a wavelength range between 200 and 500 nanometers.

27. A lighting device comprising:

a photovoltaic system that is at least partially transparent and accepts powering light;

a light emitting diode (LED) in communication with a battery and omits illuminating light;

a controller in communication with the photovoltaic system, the LED, and the battery;

a color conversion optic to convert a solar light to the powering light and to convert the illuminating light to a converted light, the color conversion optic including a conversion material selected from a group consisting of phosphors and quantum dots; and an electro-active optic located adjacent to the photovoltaic system;

wherein the electro-active optic is variable between being at least partially transparent and at least partially non-transparent;

wherein the photovoltaic system generates electrical power to be stored by the battery when the lighting device operates in a charge state, and wherein the lighting element is driven by the electrical power stored by the battery when the lighting device operates in a power state, and wherein the controller selectively enables operation between the charge state and the power state.

28. A lighting device according to claim 27 wherein the color conversion optic is positioned adjacent to the electro-active optic.

29. A lighting device according to claim 27 wherein the controller is communicatively connected to a sensor to receive sensory information; and wherein the controller analyzes the sensory information to control operation between the power state and the charge state.

30. A lighting device according to claim 27 wherein the controller includes a timer, wherein the controller analyzes data provided by the timer to control operation between the power state and the charge state.

31. A lighting device according to claim 27 wherein the controller is communicatively connected to a radio logic board to transmit and receive communication information; and wherein the communication information is used by the controller to control operation between the power state and the charge state.

32. A lighting device according to claim 27 wherein the light emitting diode emits the illuminating light within a wavelength range between 200 and 500 nanometers.

33. A method for using a lighting device, the lighting device comprising a photovoltaic system, a lighting element in communication with a battery, a controller, and a color conversion optic that is movable, the method comprising:

selectively enabling operation between a charge state and a power state using the controller, wherein operating in the charge state is defined by receiving a solar light by the color conversion optic, converting the solar light into a powering light using the color conversion optic;

receiving the powering light and generating electrical power to be stored by the battery using the photovoltaic system;

wherein operating in the power state is defined by driving the lighting element using the electrical power stored by the battery to emit an illuminating light, and receiving the illuminating light and converting the illuminating light into a converted light using the color conversion optic.

34. A method according to claim 33 further comprising moving the color conversion optic between a first position and a second position; wherein the first position is defined as the color conversion optic being positioned adjacent to the photovoltaic system to convert the solar light to the powering light, and wherein the second position is defined as the color conversion optic being positioned adjacent to the lighting element to convert the illuminating light to the converted light.

35. A method according to claim 34 wherein the color conversion optic is moved between the first position and the second position using an electromechanical device.

36. A method according to claim 33 further including receiving and reflecting the solar light and the illuminating light using a repositionable mirror adjacent to the color conversion optic.

37. A method according to claim 36 wherein the repositionable mirror is included in a microelectromechanical system (MEMS).

38. A method according to claim 33 further comprising operating the lighting device in the charge state and power state substantially simultaneously.

39. A method according to claim 33 wherein the controller includes a timer; and further comprising analyzing the data provided by the timer using the controller to control operating between the power state and the charge state.

40. A method according to claim 33 further including receiving sensory information and analyzing the sensory information to control operation between the power state and the charge state.

41. A method according to claim 40 further including detecting whether the solar light is present using a sensor in communication with the controller and generating the sensory information relating to a presence of the solar light.

42. A method according to claim 33 wherein the controller is communicatively connected to a radio logic board to transmit and receive communication information; and further including operating between the power state and the charge state based on the communication information.

43. A method according to claim 33 wherein the lighting element is a light emitting diode.

44. A method according to claim 43 wherein the light emitting diode emits the illuminating light within a wavelength range between 200 and 500 nanometers.

45. A method according to claim 33 wherein the color conversion optic includes a conversion material that is selected from a group consisting of phosphors and quantum dots.

46. A method according to claim 33 wherein the photovoltaic system is at least partially transparent.

47. A method according to claim 33 wherein an electro-active optic is located adjacent to the photovoltaic system; further comprising varying the electro-active optic to be at least partially transparent during the power state and at least partially non-transparent during the charge state.

* * * * *

UNITED STATES PATENT AND TRADEMARK OFFICE
Certificate

Patent No. 8,439,515 B1 Patented: May 14, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Fredric S. Maxik, Indialantic, FL (US); Robert R. Soler, Cocoa Beach, FL (US); David E. Barine, Cocoa, FL (US); and Eric Bretschneider, Satellite Beach, FL (US).

Signed and Sealed this Twenty-fifth Day of March 2014.

SHERIEF BADAWI
*Supervisory Patent Examiner*
Art Unit 2156
Technology Center 2100